United States Patent [19]

Nagasawa

[11] Patent Number: 4,537,174

[45] Date of Patent: Aug. 27, 1985

[54] OUTPUT SUPPLY CONTROL APPARATUS FOR INTERNAL COMBUSTION ENGINE MAGNETO GENERATOR

[75] Inventor: Masao Nagasawa, Kariya, Japan

[73] Assignee: Nippondenso Co., Ltd., Kariya, Japan

[21] Appl. No.: 480,924

[22] Filed: Mar. 31, 1983

[30] Foreign Application Priority Data

| | | | |
|---|---|---|---|
| Apr. 2, 1982 | [JP] | Japan | 57-55699 |
| Apr. 22, 1982 | [JP] | Japan | 57-67549 |
| May 7, 1982 | [JP] | Japan | 57-77059 |
| May 17, 1982 | [JP] | Japan | 57-82890 |
| Sep. 13, 1982 | [JP] | Japan | 57-160246 |
| Oct. 25, 1982 | [JP] | Japan | 57-187160 |

[51] Int. Cl.[3] ..... F02P 1/00

[52] U.S. Cl. ..... 123/604; 123/599; 310/70 R; 310/70 A

[58] Field of Search ..... 123/604, 599; 310/70, 310/70 A

[56] References Cited

U.S. PATENT DOCUMENTS

| | | | |
|---|---|---|---|
| 3,358,665 | 12/1967 | Carmichael | 123/599 |
| 3,720,194 | 3/1973 | Mallory | 123/599 |
| 3,750,637 | 8/1973 | Minks | 123/599 |
| 3,974,816 | 8/1976 | Henderson | 123/599 |
| 3,998,198 | 12/1976 | Jereb | 123/599 |
| 4,176,643 | 12/1979 | Beeghly | 123/599 |
| 4,216,756 | 8/1980 | Mura | 123/599 |
| 4,413,608 | 11/1983 | Beeghly | 123/599 |

FOREIGN PATENT DOCUMENTS

| | | | |
|---|---|---|---|
| 403641 | 2/1940 | Japan | 123/599 |

*Primary Examiner*—Ronald B. Cox

*Attorney, Agent, or Firm*—Cushman, Darby & Cushman

[57] ABSTRACT

An output supply control apparatus controls the supply of an output from an internal combustion engine magneto generator to its loads so as to effectively utilize the magneto generator. The desired ignition energy is obtained by charging a discharge capacitor of a contactless ignition system with a high induced voltage produced upon the rapid interruption of the short-circuit current in the generating coil, and also any other load such as a battery or lamp is energized by the high induced voltage exceeding a predetermined value. A constant voltage supply for the contactless ignition system ignition signal generating circuit is operated by the generating coil output current preceding the interruption. A regulator is included which monitors a lamp load voltage to commutate or transfer an excess output to the battery load and is operable in response to an overvoltage. The positive-going and negative-going half cycle outputs of the generating coil are interrupted and the resulting high induced voltages are used to charge the ignition capacitor and the battery, respectively.

14 Claims, 24 Drawing Figures

OUTPUT SUPPLY CONTROL APPARATUS FOR INTERNAL COMBUSTION ENGINE MAGNETO GENERATOR

BACKGROUND OF THE INVENTION

The present invention relates to apparatus for effectively utilizing the output from a magneto generator of an internal combustion engine, and more particularly to an output supply control apparatus for effectively supplying the magneto generator output to such loads as the battery, lamps and contactless ignition system of a vehicle.

In a known type of an internal combustion engine contactless ignition system of the capacitor discharge type employing an ignition capacitor charged by a magneto generator, in order to maintain the capacitor voltage substantially constant throughout a range of low to high engine speeds, a capacitor charging source includes a low-speed coil having a large number of turns of fine wire for charging the capacitor mainly at low engine speeds and a high-speed coil having a smaller number of turns of relatively heavy wire for charging the capacitor mainly at high engine speeds and the capacitor is charged directly by the output from the coils.

However, the known apparatus of the above type has the following disadvantages.

(1) The necessity for two low-speed and high-speed coils of different specifications as capacitor charging generating coils complicates the construction. Also the size is increased and the physical size of the magneto generator is increased.

(2) The low-speed generating coil has a large number of turns (3,000 to 7,000 turns) of fine wire (wire diameter is 0.13 to 0.16 mm) so that the working property is deteriorated and troubles tend to occur from the quality point of view.

(3) An attempt to increase the secondary voltage or the capacitor voltage at low engine speeds will also increase the secondary voltage or the capacitor voltage at intermediate and high engine speeds and thus the voltage rating of the ignition coil or the semiconductor device will become insufficient.

(4) Depending on circumstances, the capacitor voltage undergoes large variations relative to the engine speeds under the effects of the capacity of the electric units, etc., with the result that the ignition signal generating circuit cannot generate a sufficient constant voltage output at low engine speeds and also the increased capacitor voltage at high engine speeds requires the use of high capacity components for voltage regulator circuit elements.

(5) In addition to the generating coils forming the ignition capacitor charging source, another generating coil of a different specification must be provided separately for supplying power to another load such as the battery, with the result that not only the generator construction is complicated further but also the generating efficiency of the generator tends to be degraded.

SUMMARY OF THE INVENTION

It is therefore the general object of the present invention to provide a magneto generator output supply control apparatus which ensures effective utilization of the output of a magneto generator which varies with its operating speed thereby overcoming the foregoing deficiencies in the prior art. In accordance with the basic concept of the invention, the generator output supplied to at least one load is monitored and controlled so that any excess output is short-circuited or supplied suitably to another load and in this way a generator output suitable for each load is supplied.

It is a specific object of the invention to provide an internal combustion engine contactless ignition system so designed that with one half cycle output of a generating coil being substantially short-circuited by a short-circuiting semiconductor switching element connected in parallel with an ignition discharge capacitor, the capacitor is charged by a high voltage induced in the generating coil when the semiconductor switching element is turned off and the other half cycle output of the generating coil is short-circuited by a diode (or supplied to other loads), thus allowing the generating coil having a smaller number of turns of heavy wire to charge the capacitor satisfactorily and prevent the generation of heat in the respective elements (or supply the power to other loads).

It is another object of the invention to provide an internal combustion engine contactless ignition system in which a voltage regulator circuit for an ignition signal generating circuit is capable of generating a sufficient constant voltage output even at low engine speeds and the voltage regulator circuit elements are reduced in size.

It is another object of the invention to provide a magneto generator output supply control apparatus so designed that, contrary to the prior art magneto generator for an internal combustion engine installed in a two-wheeled vehicle or snow sledge in which the magneto generator output is supplied to the respective loads from a single output terminal through a rectifier, each of a plurality of output terminals is connected to one of different loads and a thyristor is provided such that upon reaching a preset voltage or current by one of the loads the generator output is switched over to the other load, thereby making the matching easier due to the different loads being operated independently of each other and ensuring effective utilization of the generator output.

It is another object of the invention to provide a magneto generator output supply control apparatus for the above type of contactless ignition system in which while the capacitor is charged by a high voltage induced in the generating coil, the battery is charged by the induced high voltage as soon as it exceeds a predetermined value and the one half cycle output of the generating coil is short-circuited by the regulator when the charged battery voltage exceeds a predetermined battery voltage thus allowing the generating coil having a smaller number of turns of heavy wire to charge the capacitor satisfactorily, supply power to the battery while preventing the generation of heat in the respective elements, control the battery voltage satisfactorily and positively prevent the generation of heat in the respective elements even if the battery terminal is disconnected.

It is another object of the invention to provide such magneto generator output supply control apparatus in which the high voltage induced in the generating coil is supplied to other loads such as the battery when it exceeds a predetermined value, and the other half cycle output of the generating coil is substantially short-circuited by a second shorting circuit such that a high voltage of the opposite polarity induced in the generating coil upon opening of the second shorting circuit is supplied to the other loads such as the battery, thus allowing the generating coil having a smaller number of turns of heavy wire to charge the capacitor satisfactorily, supply the power to any other load such as the battery, simplify the construction of the generator and improve the generating efficiency of the generator.

DESCRIPTION OF THE PREFERRED EMBODIMENTS

Figure 1:
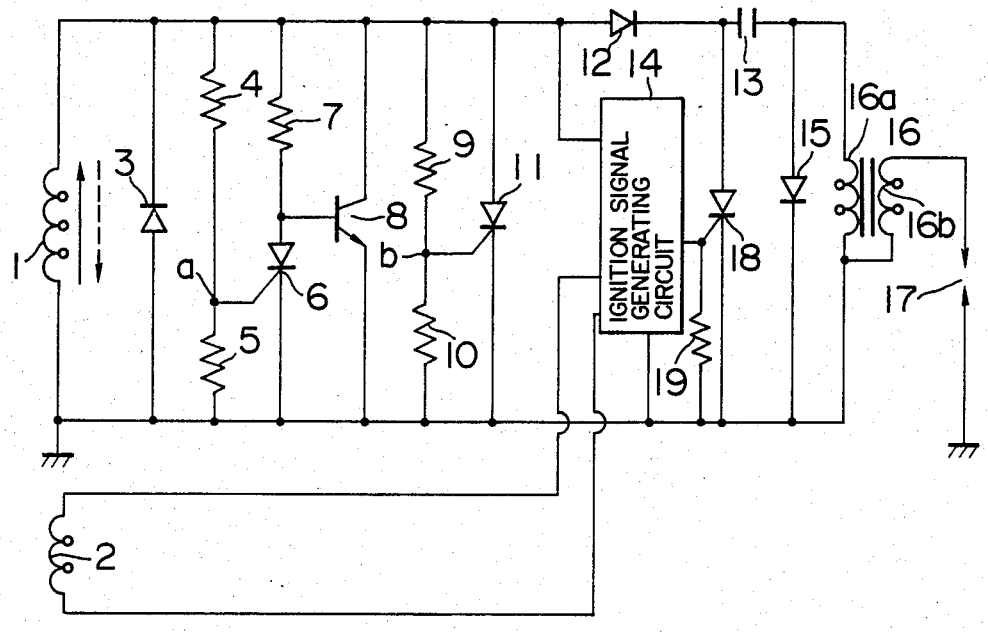
FIG. 1 is a circuit diagram showing a first embodiment of an apparatus of a first-type according to the invention.

In the accompanying drawings showing preferred embodiments of the invention, like reference numerals designate component parts having the similar or corresponding functions.

FIG. 1 shows a contactless ignition system incorporating a first embodiment of a first-type apparatus according to the invention. Numeral 1 designates a generating coil of a magneto generator including 200 to 600 turns of a wire having a diameter of 0.3 to 1.0 mm, for example, and the generating coil 1 is about four times in wire diameter and about one tenth in number of turns as compared with that of a magneto generator of the same physical size. Numeral 2 designates a timing sensor coil for generating an output signal at a reference position, 3 a shorting diode for short-circuiting a negative-going output of the generating coil 1, and 4 and 5 voltage dividing resistors connected in series with each other between the terminals of the generating coil 1 and having their voltage dividing point a connected to the gate of a thyristor 6. The thyristor 6 is connected between the base and emitter of a transistor 8. Numeral 7 designates a base resistor of the transistor 8, and an interruption control circuit is formed by the resistor 7, the thyristor 6 and the resistors 4 and 5. The transistor 8 serves as a shorting semiconductor switching element for short-circuiting the positive-going output of the coil 1. Numerals 9 and 10 designate voltage dividing resistors connected in series with each other between the terminals of the coil 1 and having their voltage dividing point b connected to the gate of a thyristor 11. Thus, the resistors 9 and 10 are short-circuited when the generated voltage of the coil 1 after the turning off of the transistor 8 exceeds a preset value. The thyristor 11 and the resistors 9 and 10 form a high voltage responsive circuit. Numeral 12 designates a discharge blocking diode, 13 an ignition capacitor, and 14 a known type of electronic ignition signal generating circuit adapted to use the positive-going output of the generating coil 1 as a power supply and receive the output signal of the timing sensor coil 2 as an input so as to electronically determine the desired timing of ignition and thereby generate an ignition signal. Numeral 15 designates a dc arcing diode, 16 an ignition coil, **16*a* a primary winding, and 16*b* a secondary winding. Numeral 17 designates a spark plug, and 18 an ignition thyristor serving as an ignition semiconductor switching element whereby when the ignition signal from the ignition signal generating circuit 14 is applied to its gate, the thyristor 18 is turned on and thus the charge stored in the capacitor 13 is supplied to the primary winding 16*a* of the ignition coil 16. Numeral 19** designates a resistor.

Figure 2:
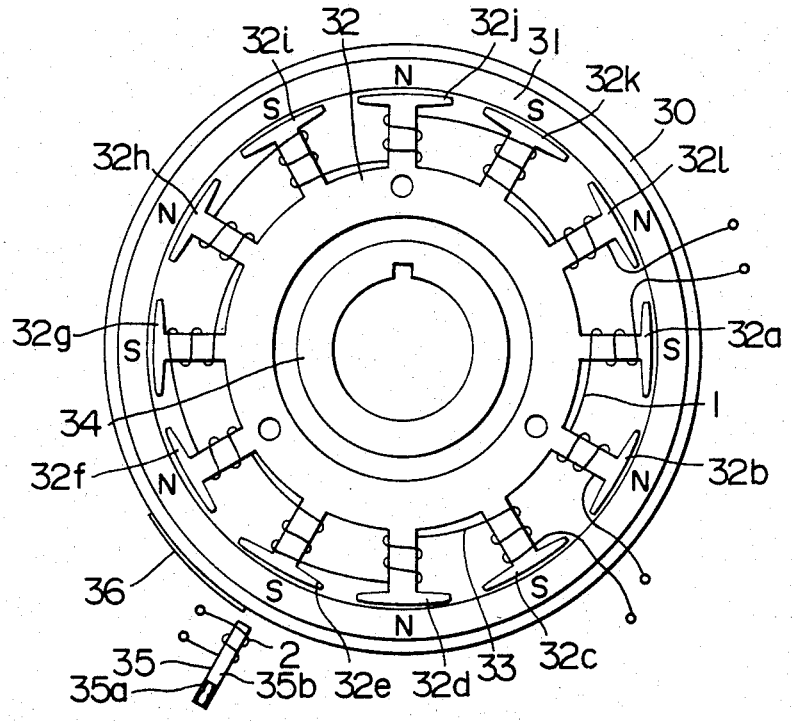
FIG. 2 is a bottom view of a magneto generator applied to the apparatus shown in FIG. 1.
Figure 3:
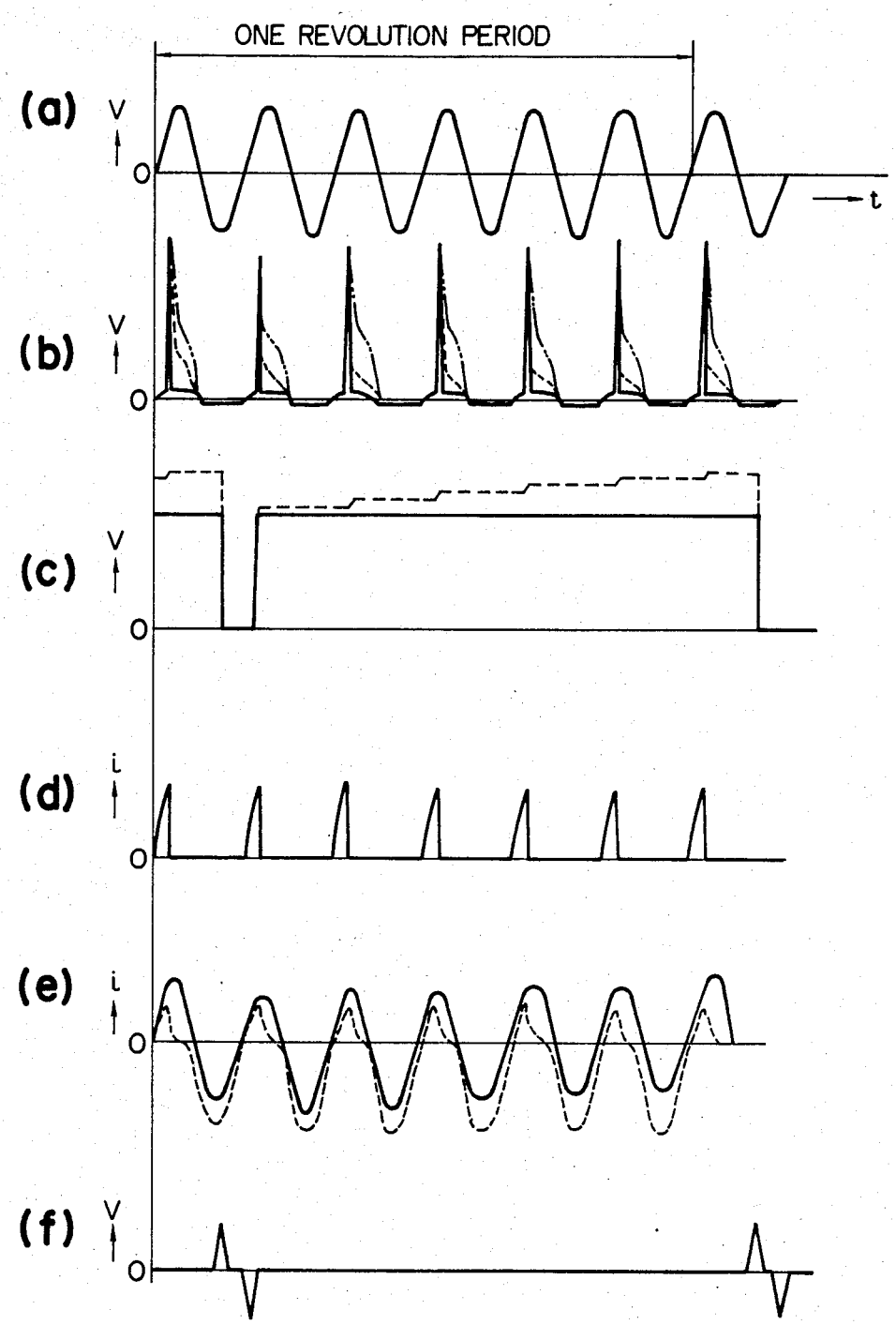
FIG. 3 shows a plurality of waveforms useful for explaining the operation of the apparatus shown in FIG. 1.

Next, the construction of the magneto generator used with this embodiment will be described. In FIG. 2, numeral 30 designates a cup-shaped rotor, and 31 a ring-shaped main magnet fitted to the inner periphery of the rotor 30 and magnetized to provide a total of 12 alternate north and south poles arranged at equal intervals. Numeral 32 designates a ring-shaped stator core fixedly mounted on the side wall of the engine and including 12 projections **32*a* to 32*l* formed on its outer periphery at equal intervals. Numeral 33 designates lamp load coils respectively wound on the ten projections 32*c* to 32*l* and connected in series with each other and serving as a power supply for such loads as lamps. Numeral 34 designates a boss fastened to the engine crankshaft with rivets which are not shown, and the rotor 30 is fastened to the boss 34 with rivets which are not shown. Numeral 35 designates an ignition signal timing sensor attached to the side wall of the engine along the outer periphery of the rotor 30 and including a diameterically magnetized permanent magnet 35*a*, a core 35*b* fixed to the permanent magnet 35*a* and the sensor coil 2 wound on the core 35*b*. Numeral 36 designates a projection of a magnetic material mounted on the outer periphery of the rotor 30, and the core 35*b* is positioned to face the projection 36 so that an output voltage as shown in (f) of FIG. 3 is generated in the sensor coil 2 due to a magnetic flux change caused when the core 35***b* and the projection 36 are opposite to each other. The capacitor charging generating coil 1 is wound in series connection on the projections 32*a* and 32*b* so that the rotation of the main magnet 31 generates 6 cycles of no-load ac voltage for every revolution of the magneto generator rotor 30 as shown in (a) of FIG. 3.

Assuming now that a half cycle output of the solid line arrow direction (positive direction) in FIG. 1 begins to generate in the generating coil 1, a base current flows to the transistor 8 through a circuit including the coil 1, the resistor 7, the base-emitter section of the transistor 8 and the ground so that the collector-emitter section of the transistor 8 becomes conductive and the output of the coil 1 is short-circuited. The resulting increase in the short-circuit current of the transistor 8 shown in (d) of FIG. 3 increases the voltage drop across the collector and emitter of the transistor 8 and thus the voltage at the junction point a of the voltage divider including the resistors 4 and 5 increases. When this voltage reaches a preset value (e.g., a voltage value corresponding to the short-circuit current of 0.5 to 4 A), the thyristor 6 is turned on and the base-emitter section of the transistor 8 is short-circuited. Thus, the collector-emitter section of the transistor 8 is turned off and the short-circuit current is interrupted rapidly. At this time, a high induced voltage is generated in the coil 1 as shown in (b) of FIG. 3 and this high voltage sufficiently charges the capacitor 13 through a circuit including the coil 1, the diode 12, the capacitor 13, the diode 15 and the ground as shown by the solid line in (c) of FIG. 3. Also, when the induced voltage exceeds a preset value (e.g., 100 to 300 V), the voltage at the junction point b of the voltage divider including the resistors 9 and 10 rises and the thyristor 11 is turned on. Thus, a short-circuit is established across the terminals of the coil 1 so that the prevention of any overvoltage and the prevention of heat generation in the resistors 4 and 7 due to the current caused by the no-load generated voltage following the induced voltage are effected and the reverse current value of the diode 3 is held at a small value by the armature reaction. On the other hand, the negative-going output (the broken line arrow of FIG. 1) of the coil 1 is short-circuited by the diode 3 thus preventing the application of a negative-going over-voltage to the thyristors 6 and 11 and the transistor 8, and also a reverse current is supplied to the coil 1 so that the magnitude of the following positive-going generated output of the coil 1 is reduced by the armature reaction and the current in the coil 1 (the solid line in (e) of FIG. 3) and the current in the thyristor 6 are reduced. This has the effect of preventing the generation of heat in the coil 1 and reducing the size of the transistor 8, the diode 3 and the resistors 4, 5 and 7.

Then, when the ignition timing is reached, the thyristor 18 is turned on by an ignition signal determined electronically by the ignition signal generating circuit 14 in accordance with the output of the timing sensor coil 2 shown in (f) of FIG. 3 so that the charge stored in the capacitor 13 is discharged rapidly through a circuit including the capacitor 13, the thyristor 18, the ground and the primary winding 16*a* of the ignition coil 16 and a high voltage is induced in the secondary winding 16*b* of the ignition coil 16 thus producing an ignition spark at the spark plug 17. In this connection, the broken lines in (b), (c) and (e) of FIG. 3 show the case without the resistors 9 and 10 and the thyristor 11 in which, as compared with the case using these elements (the solid lines in (b), (c) and (e) of FIG. 3), the induced voltage in the coil 1 and the stored charge on the capacitor 13 are both increased and also the coil current is increased. The two-dot chain line in (b) of FIG. 3 shows the case without the resistors 9 and 10, the thyristor 11 and the diode 3 in which, as compared with the case using the diode 3, the positive-going voltage of the coil 1 after the termination of the induced voltage is increased by about two times and this leads to an increase in the current capacity of the resistors 4, 5 and 7 and the thyristor 6.

Figure 4:
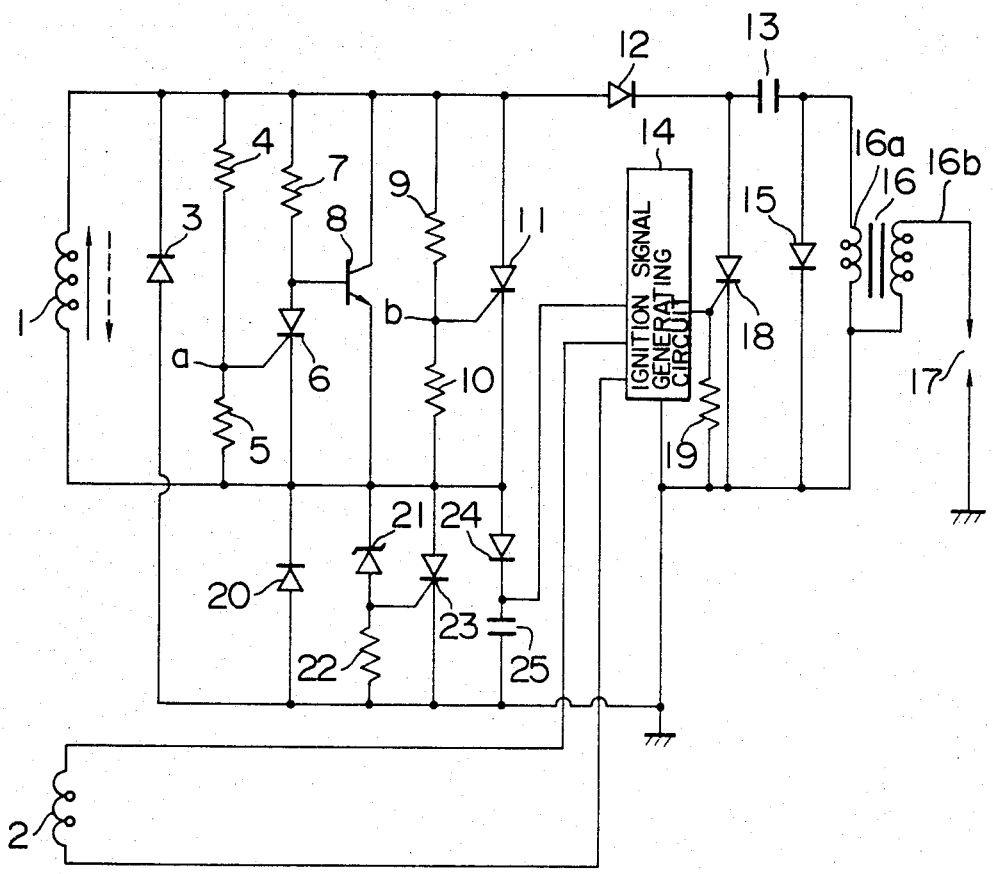
FIG. 4 is a circuit diagram showing a second embodiment of the first-type apparatus according to the invention.

FIG. 4 is a circuit diagram showing a second embodiment of the invention which differs from the embodiment of FIG. 1 in that the desired ignition power supply is obtained from the positive-going output of the solid line arrow and the negative-going output of the broken line arrow charges, through diodes 24 and 3, a capacitor 25 forming a constant voltage supply for the ignition signal generating circuit 14. The voltage of the capacitor 25 is controlled at a preset value by a voltage regulator circuit including a Zener diode 21, a resistor 22 and a thyristor 23.

While, in the above-described embodiments, the electronic ignition signal generating circuit 14 is used which receives the output signal of the timing sensor coil 2 to electronically determine an ignition timing, it is possible to use an ignition signal generating circuit so designed that the output signal of the timing sensor coil 2 is directly applied as a control signal to the thyristor 18.

The above-described embodiments of the first-type apparatus have the following remarkable effects due to the fact that there are included the shorting semiconductor switching element for substantially short-circuiting one half cycle output of the capacitor-charging generating coil and the interruption control circuit for turning off the shorting semiconductor switching element when the short-circuit current caused by the capacitor charging half cycle output of the generating coil is flowing sufficiently in the shorting semiconductor switching element whereby when the shorting semiconductor switching element is turned off the capacitor is charged, and the other half cycle output of the generating coil is short-circuited by the shorting diode.

(1) As compared with the prior art apparatus requiring two capacitor charging generating coils of different specifications including one having a large number of turns of fine wire and another having a smaller number of turns of relatively heavy wire, only the coil having a small number of turns of heavy wire is used with the resulting simplification of the construction and reduction in the physical size.

(2) The degree of setting freedom of the capacitor voltage or the secondary voltage is increased with the result that a satisfactory ignition performance is ensured even at low engine speeds and the starting performance is improved.

(3) There is no need to use a generating coil of fine wire and this eliminates the occurrence of troubles from the quality point of view.

(4) Due to the fact that one half cycle output of the generating coil is suppressed by the armature reaction due to the short-circuiting of the other half cycle output of the generating coil through the shorting diode, the current flow in the respective elements is reduced and the generation of heat therein is reduced.

Moreover, in accordance with the above embodiment the voltage induced in the generating coil upon the turning off of the shorting semiconductor switching element is detected so that the one half cycle output of the generating coil is substantially short-circuited each time the induced voltage exceeds a preset value, the induced voltage of the generating coil is maintained at the preset value and the following successively generated undesired voltages are short-circuited, thereby further reducing the generation of heat in the respective elements and also reducing the generation of heat in the generating coil.

Figure 5:
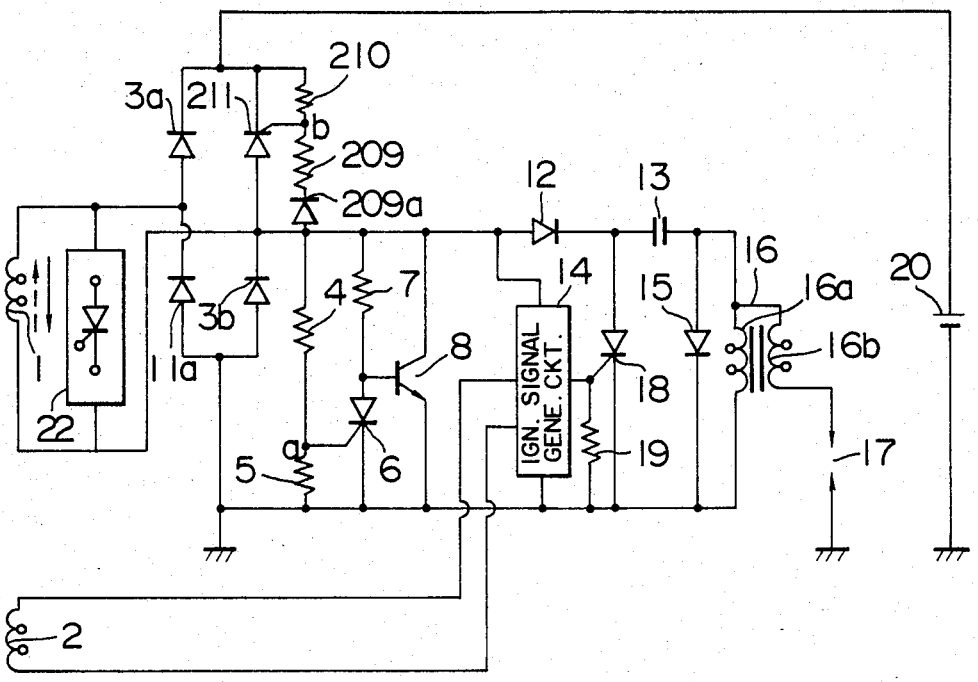
FIG. 5 is a circuit diagram showing a first embodiment of an apparatus of a second type according to the invention.

Referring now to FIG. 5, there is illustrated a first embodiment of an apparatus of a second type according to the invention in which a battery is charged by one of the two half cycle outputs of the generating coil which is not used for capacitor charging purposes. In the Figure, numerals 3*a* and 3*b* designate negative-going half cycle conducting diodes for taking and supplying to a battery 20 the negative-going half cycle output of the generating coil 1 shown by the dotted line arrow, and 4 and 5 voltage dividing resistors connected in series with each other through a diode 11*a* between the terminals of the generating coil 1 and having their voltage dividing point a connected to the gate of the thyristor 6.

Numerals 209 and 210 designate voltage dividing resistors connected in series between the terminals of a thyristor 211 through a diode 209*a* and having their voltage dividing point b connected to the gate of the thyristor 211. Thus, when the generated voltage of the coil 1 following the turning off of the transistor 8 exceeds a preset value, the thyristor 211 is turned on. Also, it is arranged so that the positive-going half cycle output of the generating coil 1 shown by the solid line arrow is supplied to the battery 20 through the thyristor 211 and the diode 11*a*. The thyristor 211, the resistors 209 and 210 and the diodes 209*a* and 11*a* form a high voltage responsive circuit. Numeral 22 designates a regulator for short-circuiting the negative-going output of the generating coil 1 shown by the broken line arrow when it exceeds a predetermined value.

Figure 6:
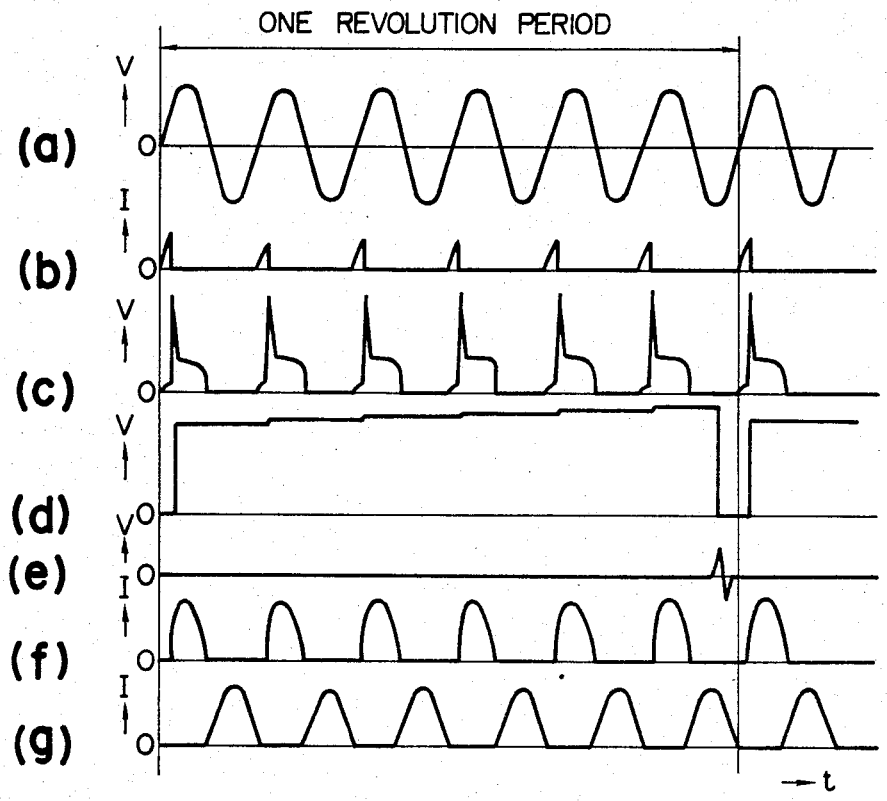
FIG. 6 shows a plurality of waveforms useful for explaining the operation of the apparatus shown in FIG. 5.

Assuming that the magneto generator shown in FIG. 2 is used with this embodiment, the rotation of its rotor generates six cycles of no-load ac voltage in the generating coil 1 for every rotation of the magneto generator rotor as shown in (a) of FIG. 6. Now, as the half cycle output of the solid line arrow direction of FIG. 5 (the positive-going direction) starts generating in the generating coil 1, in the like manner as the embodiment of FIG. 1, the collector-emitter section of the transistor 8 is turned on and the positive-going half cycle output of the coil 1 is short-circuited. When the resulting short-circuit current of the transistor 8 increases and reaches the preset value as shown in (b) of FIG. 6, the thyristor 6 is turned on and the collector-emitter section of the transistor 8 is turned off thereby interrupting the short-circuit current rapidly. At this time, a high induced voltage is generated in the coil 1 as shown in (c) of FIG. 6 and this high voltage sufficiently charges the capacitor 13 as shown in (d) of FIG. 6. Also, when the induced voltage exceeds the preset value (e.g., 100 to 300 V), the voltage at the junction point b of the voltage divider including the resistors 209 and 210 is increased and the thyristor 211 is turned on. As a result, the positive-going half cycle output of the coil 1 is supplied to the battery 20 through the thyristor 211 and the diode 11*a* and the battery 20 is charged by the current shown in (f) of FIG. 6. By charging the battery 20 in this way, the positive-going half cycle output of the coil 1 is suppressed and the application of any overvoltage to the respective elements is prevented. On the other hand, the negative-going half cycle output (the broken line arrow of FIG. 5) of the coil 1 is supplied to the battery 20 through the diodes 3*a* and 3*b* and the battery 20 is charged by the current shown in (g) of FIG. 6. By charging the battery 20 in this way, not only the negative-going half cycle output of the coil 1 is suppressed thereby preventing the application of any negative-going overvoltage to the thyristors 6 and 211 and the transistor 8 but also a negative-going current is supplied to the coil 1 so that the resulting armature reaction reduces the magnitude of the following successively generated positive-going output and the current in the coil 1 ((b) of FIG. 6) and the current flow to the thyristor 6 are both reduced. This has the effect of preventing the generation of heat in the coil 1 and reducing the size of the thyristor 6 and the resistors 4, 5 and 7.

Then, when the ignition timing is reached, the thyristor 18 is turned on by an ignition signal determined electronically by the ignition signal generating circuit 14 in accordance with the output of the timing sensor coil 2 shown in (e) of FIG. 6 and the stored charge on the capacitor 13 is discharged rapidly thereby producing an ignition spark at the spark plug 17.

In this case, the generation of an ignition signal from the ignition signal generating circuit 14 should preferably take place during the time that there is the half cycle output of the coil 1 shown by the broken line arrow of FIG. 5 and not used as the ignition power supply. This is to prevent the thyristor 18 from being turned on by an ignition signal in the presence of the solid line arrow direction half cycle output of the coil 1 thereby causing the thyristor 18 to short-circuit that half cycle output and decreasing the battery charging current correspondingly.

Figure 7:
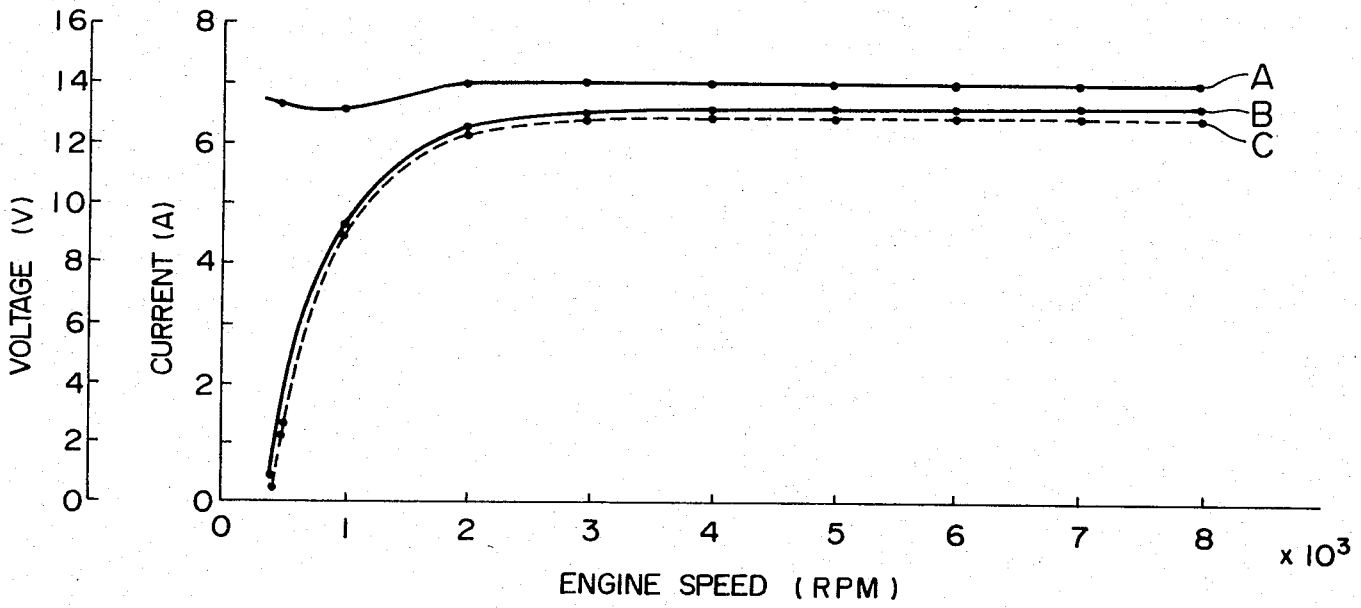
FIG. 7 is an engine speed versus battery voltage and current characteristic diagram of the apparatus shown in FIG. 5.

FIG. 7 shows an engine speed versus battery voltage and battery charging current characteristic diagram of the first embodiment of the second-type apparatus, in which a characteristic A shows the battery voltage, a characteristic B shows the battery charging current in a case where the output of the coil 1 is used only for battery charging purposes and a characteristic C shows the battery charging current in the circuitry of FIG. 5 utilizing the output of the coil 1 for both battery charging and ignition power supply purposes. Where the output of the coil 1 is used for both battery charging and ignition power supply purposes, the resulting battery charging current is substantially the same as in the case where the output of the coil 1 is used only for battery charging purposes.

Figure 8:
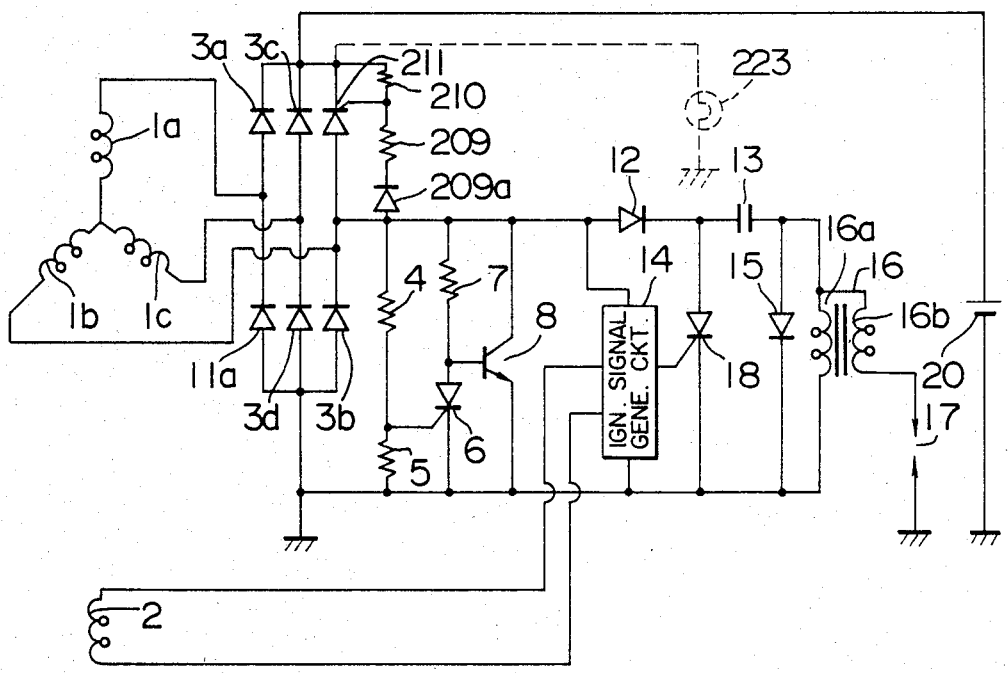
FIGS. 8 to 12 are circuit diagrams showing second to sixth embodiments of the second-type apparatus according to the invention.

FIG. 8 shows a second embodiment of the second-type apparatus which differs from the first embodiment of FIG. 5 in that a magneto generator including generating coils 1*a*, 1*b* and 1*c* differing in phase by 120° is used, that the coils 1*a*, 1*b* and 1*c* are connected to form a three-phase Y network and that the three-phase Y network is connected to the battery 20 through a three-phase full-wave rectifier including the diodes 3*a* to 3*d* and 11*a* and the thyristor 211 thereby using a portion of the half cycle output of one of the three phases as an ignition power supply. In the Figure, instead of connecting to the battery 20, the cathode of the thyristor 211 may be connected to a lamp 223 as shown by the broken line so as to turn it on.

Figure 9:
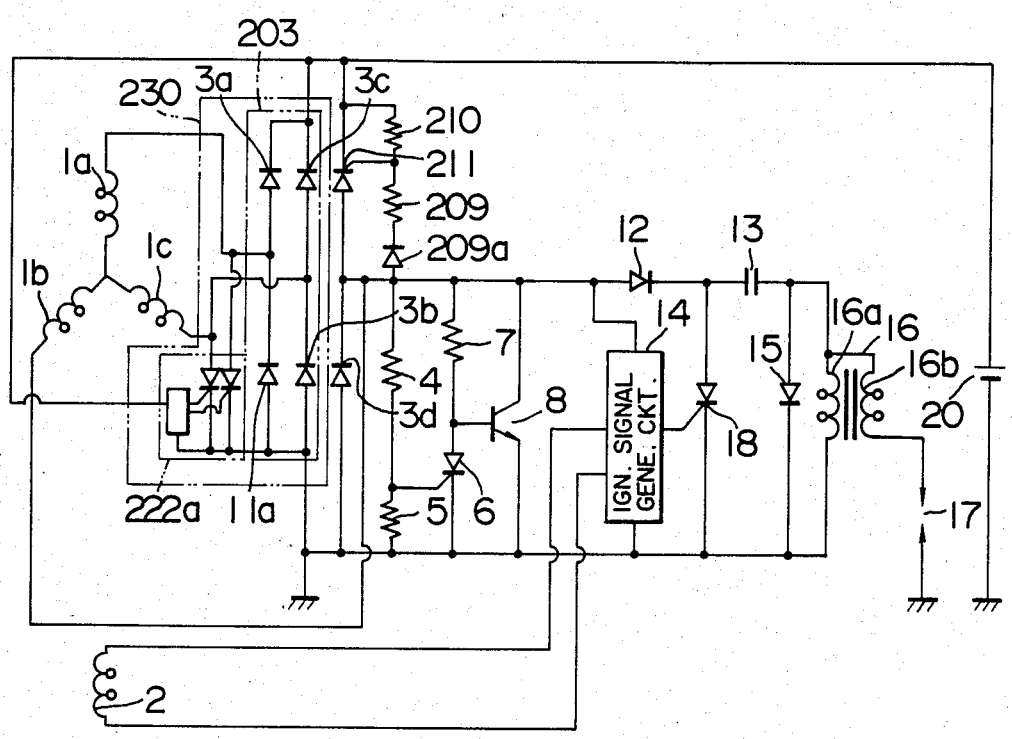

FIG. 9 shows a third embodiment of the second-type apparatus according to the invention which is different from the second embodiment of FIG. 8 in that the battery charging half cycle outputs of the generating coils 1*a* to 1*c* are subjected to voltage regulation by a regulator 222*a* of a known single phase full-wave short-circuiting type and the battery 20 is charged by the outputs of the coils 1*a* to 1*c* by utilizing a single-phase full-wave rectifier 203 combined with the regulator 222*a*. In accordance with this embodiment, the desired circuit can be constructed by means of a single-phase full-wave short-circuiting regulator 230 with full-wave rectifier which is commercially available at present. In this case, the cathode of the thyristor 211 may be connected to the anode side of the diode 3*c*.

Figure 10:
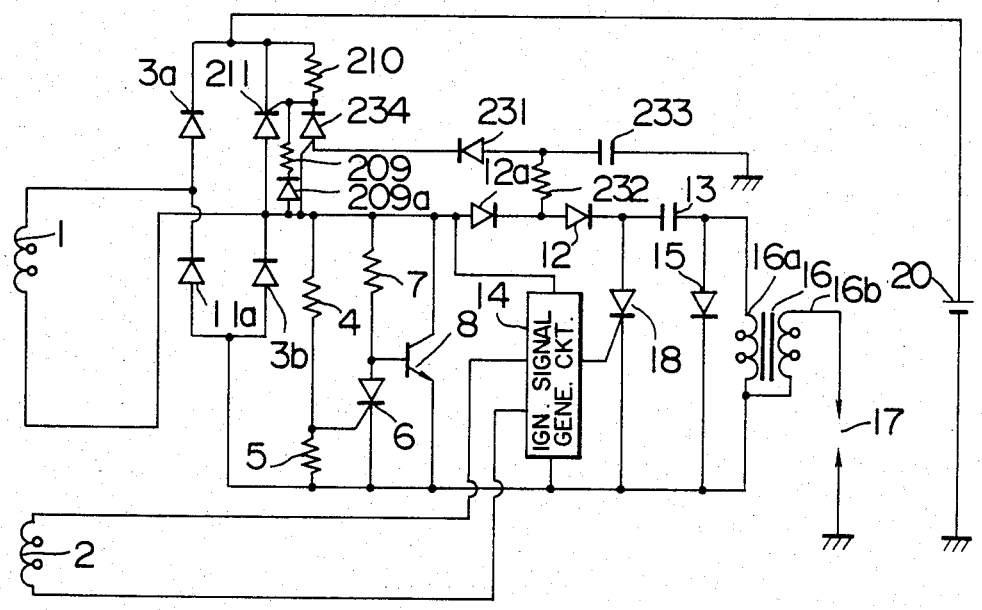

FIG. 10 shows a fourth embodiment of the second-type apparatus of the invention which differs from the first embodiment of FIG. 5 in that the stored charge on a capacitor 233 charged by the induced voltage of the coil 1 through a diode 12*a* and a resistor 232 is supplied to the gate of the thyristor 211 through a diode 231 and a programmable unijunction transistor 234 such that at low engine speeds the conduction control timing of the thyristor 211 occurs just after the time at which the induced voltage of the coil 1 following the turning off of the transistor 8 exceeds the peak point. In accordance with this embodiment, even at low engine speeds when the induced voltage of the coil 1 after the turning off of the transistor 8 is lower than the predetermined value, the battery 20 can be charged with the post-capacitor-charging induced voltage of the coil 1 after the turning off of the transistor 8. In this case, the resistor 209 and the diode 209*a* may be eliminated such that even at higher engine speeds the thyristor 211 is turned on just after the time at which the induced voltage of the coil 1 following the turning off of the transistor 8 exceeds the peak point.

Figure 11:
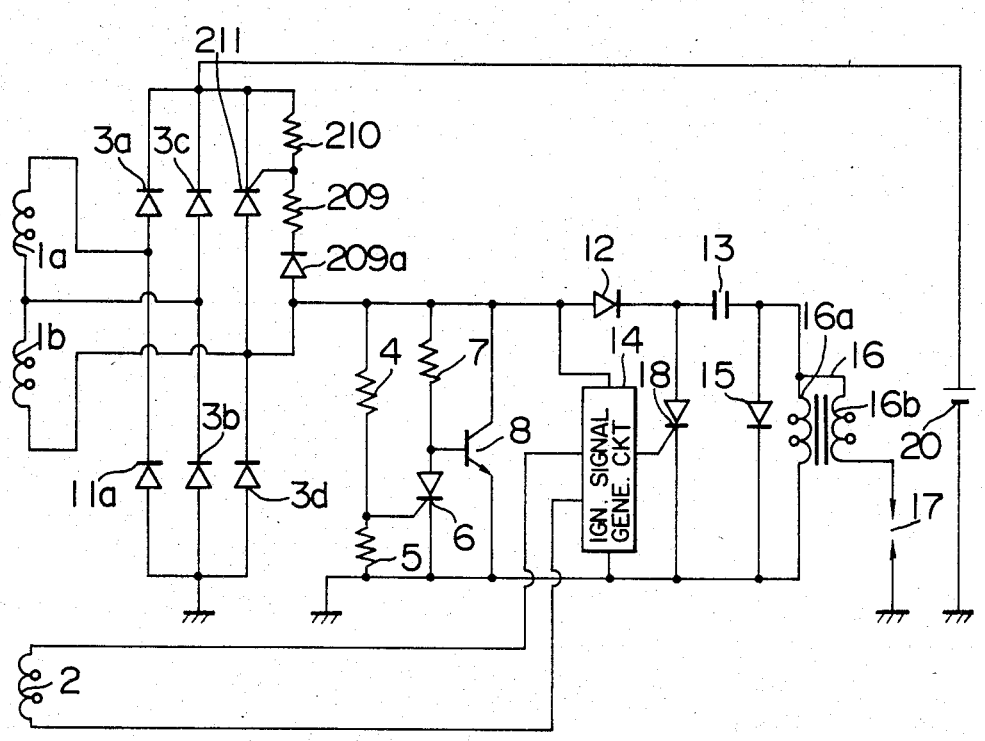

FIG. 11 shows a fifth embodiment of the second-type apparatus according to the invention which differs from the second embodiment in that only the two generating coils 1*a* and 1*b* are used to generate outputs of the same phase and their terminals are connected to the three-phase full-wave rectifier. By so arranging, it is possible to arbitrarily select the coil wire diameter and number of turns of the coils 1*a* and 1*b*, respectively, to suit the charging of the battery 20 and the ignition power supply requirement, respectively.

Figure 12:
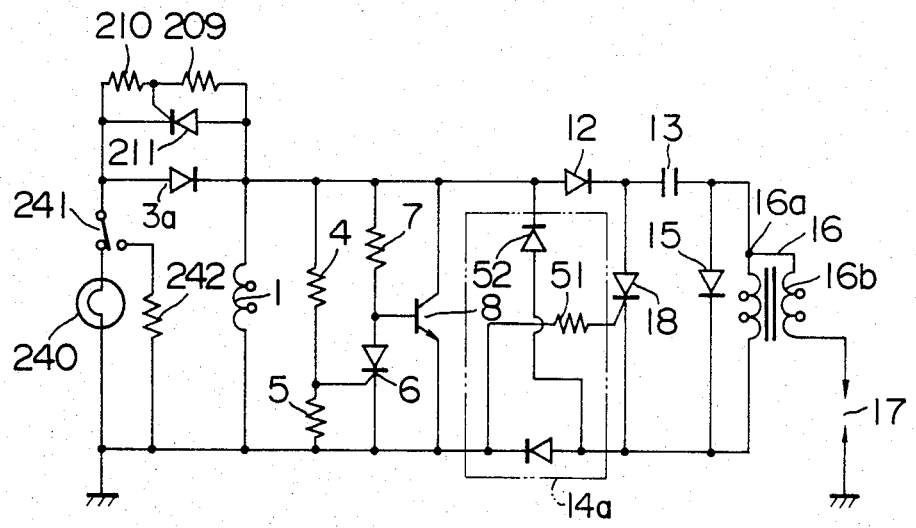

FIG. 12 shows a sixth embodiment of the second-type apparatus of the invention which differs from the first embodiment in that the output of the coil 1 is supplied to a lamp 240 in place of the battery 20 and an ignition signal generating circuit 14*a* is used to supply the negative-going output of the coil 1 as an ignition signal to the gate of the thyristor 18 through a resistor 51 and a diode 52. In FIG. 12, numeral 241 designates an operation switch for turning on and off the lamp 240, and 242 a resistor adapted to be connected to the coil 1 when the lamp 240 is turned off.

With the above-described embodiments, the high voltage responsive circuit including the resistors 209 and 210 and the thyristor 211 may be eliminated as the case may be. Further, while, in these embodiments, the electronic ignition timing signal generating circuit 14 for receiving the output signal of the timing sensor coil 2 and determining an ignition timing electronically or the ignition signal generating circuit 14*a* for supplying the negative-going output of the coil 1 as an ignition signal is used, it is possible to use an ignition signal generating circuit which directly applies the output signal of the timing sensor coil 2 as a control signal to the thyristor 18.

With the above-described embodiments of the second-type apparatus, by virtue of the fact that there are included the shorting semiconductor switching element for substantially short-circuiting one half cycle output of a generating coil or coils and the interruption control circuit for turning off the shorting semiconductor switching element when the shorting semiconductor switching element has a sufficient flow of the short-circuit current due to the capacitor-charging half cycle output of the generating coil whereby the capacitor is charged by a high voltage induced in the generating coil when the shorting semiconductor switching element is turned off and the other half cycle output of the generating coil is supplied to any other load through the negative-going half cycle conducting diode, the one half cycle output of the generating coil is suppressed by the armature reaction due to the supply of the other half cycle output of the generating coil to the other load via the negative-going half cycle conducting diode and the current flowing to the respective elements is reduced thereby effectively supplying the power to the other load while reducing the generation of heat in the respective elements. Further, by virtue of the fact that the voltage induced in the generating coil upon turning off the shorting semiconductor switching element is detected so that the one half cycle output of the generating coil is supplied successively to the other load each time the induced voltage exceeds a preset voltage, not only the induced voltage of the generating coil is maintained at the preset value and the following successively generated undesired voltages are supplied to the other load thereby effectively supplying the power to the other load but also the generation of heat in the elements is reduced further and also the generation of heat in the generating coil is reduced.

Figure 13:
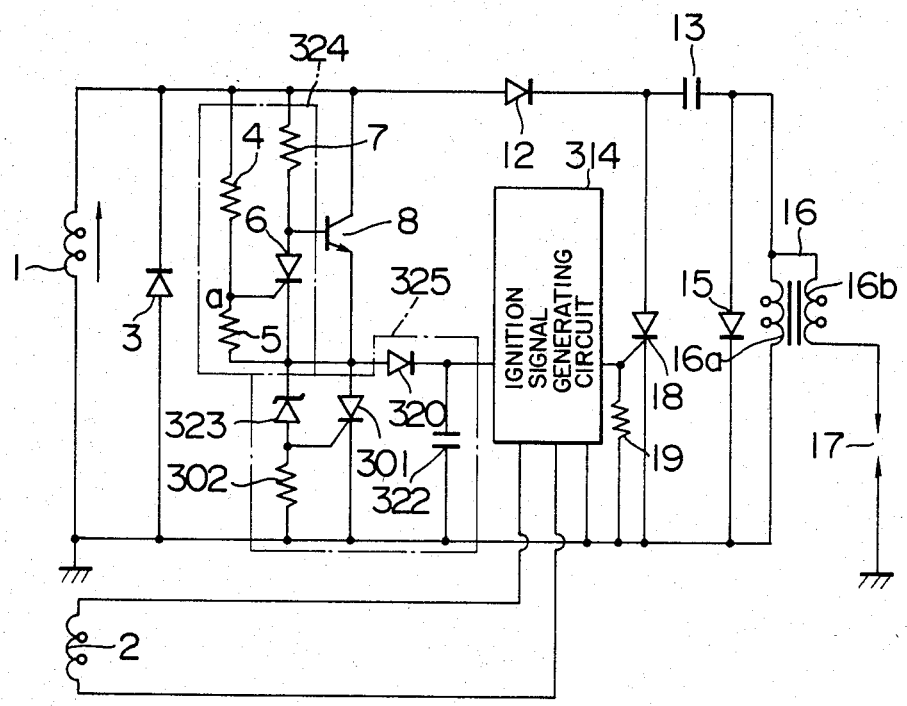
FIGS. 13 and 14 are circuit diagrams showing first and second embodiments of an apparatus of a third type according to the invention.

Referring now to FIG. 13, there is illustrated a first embodiment of a third-type apparatus according to the invention in which the required constant voltage supply for the ignition signal generating circuit is provided by a portion of that half cycle output of a generating coil which is used for capacitor charging purposes. In the Figure, numeral 314 designates a known type of electronic ignition signal generating circuit adapted to receive the output signal of a timing sensor coil 2 and operable by using as a constant voltage supply the output from an ignition signal generating circuit voltage regulator circuit which will be described later, thereby electronically determining the proper ignition timing and generating an ignition signal in response for example to the charging and discharging of a capacitor. Numeral 8 designates a transistor whose collector-emitter path is connected between the terminals of a generating coil 1 through a thyristor 301 such that the capacitor charging half cycle output of the generating coil 1 is short-circuited through the thyristor 301, and the transistor 8 forms a shorting semiconductor switching element.

Numerals 4 and 5 designate voltage dividing resistors connected in series with each other between the terminals of the generating coil 1 through the thyristor 301 and having the voltage dividing point a thereof connected to the gate of a thyristor 6. A base resistor 7, the thyristor 6 and the voltage dividing resistors 4 and 5 form an interruption control circuit 324 for turning the transistor 8 off. Numeral 15 designates a diode for supplying a flywheel current to a primary winding 16*a* of an ignition coil 16 to increase the arcing time of a spark plug 17. Numeral 19 designates a resistor for adjusting the gate sensitivity of a thyristor 18. Numeral 320 designates a diode, 322 a dc power supply capacitor, 323 a dc power supply voltage regulating Zener diode, and 302 a gate resistor for the thyristor 301. An ignition signal generating circuit voltage regulator circuit 325 is formed by the thyristor 301, the gate resistor 302, the Zener diode 323, the capacitor 322 and the diode 320.

With the construction described above, the operation of this embodiment will now be described. Assuming that a 12-pole magneto generator is used, six cycles of no-load ac voltage are generated in the generating coil 1 for every rotation of the magneto generator rotor. Now, as the solid line arrow direction output (the capacitor charging half cycle) of FIG. 13 starts generating, a base current flows to the transistor 8 through a circuit including the coil 1, the resistor 7, the base and emitter of the transistor 8, the diode 320, the capacitor 322 and the ground so that the collector-emitter section of the transistor 8 is made conductive and the output of the coil 1 is substantially short-circuited. In this case, the capacitor 322 is charged through a low impedance circuit including the transistor 8 and therefore it is charged positively without any delay in charging. Then, as the charged voltage of the capacitor 322 attains a preset value, the Zener diode 323 is turned on and thus the thyristor 301 is turned on. When this occurs, the capacitor 322 is charged to a predetermined voltage and also the short-circuit current flowing from the generating coil 1 through the transistor 8 now flows through the thyristor 301 thus increasing the short-circuit current. This increase in the short-circuit current increases the voltage drop across the collector and emitter of the transistor 8 and the voltage at the junction point a of the voltage dividing circuit is increased. When this voltage attains a preset value, the thyristor 6 is turned on and the short-circuit current is interrupted rapidly. At this time, a high voltage is induced in the coil 1 and this high induced voltage charges the capacitor 13 sufficiently through a circuit including the coil 1, the diode 12, the capacitor 3, the diode 15 and ground. Then, the ignition signal generating circuit 314 uses the constant voltage output of the voltage regulator circuit 325 as a power supply and electronically computes the desired ignition timing in accordance with the output from the timing sensor coil 2 thereby generating an ignition signal. This ignition signal is applied to the gate circuit of the thyristor 18 so that the thyristor 18 is turned on and an ignition spark is produced at the spark plug 17.

Since the above-described embodiment is designed so that the transistor 8 is turned off when the short-circuit current therein reaches a predetermined value, there are great advantages that the current flowing through the thyristor 301 can be maintained substantially constant irrespective of the engine speed and hence elements which are low in current capacity and small in size can be used for the circuit elements of the voltage regulator circuit 325 and that even at low engine speeds the capacitor 322 can be charged sufficiently in response to the turning on of the transitor 8 thereby producing a sufficient constant voltage output.

Figure 14:
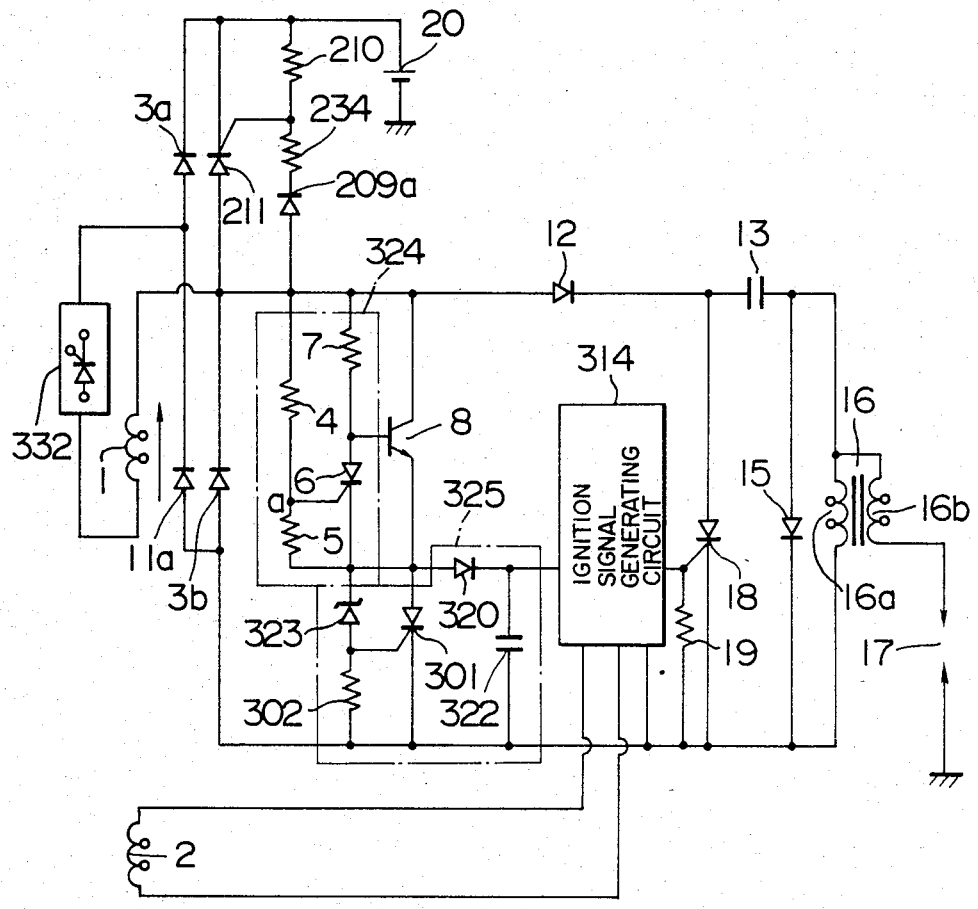

FIG. 14 shows a second embodiment of the third type apparatus according to the invention which differs from the first embodiment of FIG. 13 in that half cycle output of the generating coil 1 which is not used for capacitor charging purposes is supplied to a battery 20 through diodes 3*a* and 3*b*, and that when the induced voltage of the generating coil 1 after the turning off of the transistor 8 exceeds a predetermined value this is detected by a diode 209*a* and voltage dividing resistors 234 and 210 and a thyristor 211 is turned on thereby supplying an excess portion of the capacitor charging half cycle output of the generating coil 1 to the battery 20 through the thyristor 211 and a diode 11*a*. In the Figure, numeral 332 designates a regulator whereby when that half cycle output of the generating coil 1 which is not used for capacitor charging purposes exceeds a predetermined value, the regulator 332 is turned on so that this half cycle output is short-circuited and the battery 20 is prevented from being charged excessively.

In accordance with these embodiments of the third-type apparatus, by virtue of the fact that the ignition capacitor is charged by a high voltage induced in the generating coil upon the turning on of the shorting semiconductor switching element and that the voltage regulator circuit of the ignition signal generating circuit is operated in response to the short-circuit current and this short-circuit current is interrupted in response to substantially the same voltages throughout a range of low to high engine speeds, it is possible to ensure the generation of stable input and output voltages throughout the range of low to high speeds and prevent the application of any excessive load to the voltage regulator circuit elements including the Zener diode etc., thereby reducing the size of the elements.

Figure 15:
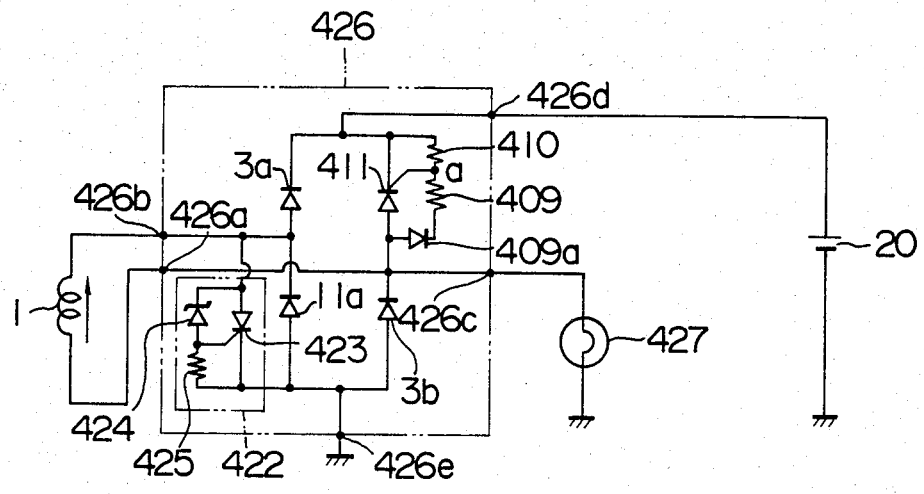
FIGS. 15 to 17 are circuit diagrams showing first and third embodiments of an apparatus of a fourth-type according to the invention.

Referring now to FIG. 15, there is illustrated a first embodiment of a fourth-type apparatus according to the invention in which the output of a generating coil is monitored and supplied selectively to a plurality of loads. In the Figure, numeral 411 designates a thyristor, 409*a* a diode, and 409 and 410 voltage dividing resistors. Numeral 20 designates a battery forming a second load, 422 a regulator, 423 a thyristor, 424 a Zener diode, and 425 a resistor. Numeral 426 designates a rectifier unit, 426*a* a first input terminal, 426*b* a second input terminal, 426*c* a first output terminal, 426*d* a second output terminal, and 426*e* a ground terminal. Numeral 427 designates a lamp forming a first load.

With the construction described above, the operation of this embodiment will now be described. The battery 20 is charged by the solid line arrow direction output of the generating coil 1 through a circuit including the coil 1, the second input terminal 426*b*, a diode 3*a*, the second output terminal 426*d*, the battery 20, the ground, the ground terminal 426*e* and a diode 3*b*. In this case, if the output voltage of the generating coil becomes higher than the preset value, the regulator 422 comes into operation and its thyristor 423 short-circuits the solid line arrow direction half cycle output of the coil 1.

Then, the lamp 427 is also turned on by the negative-going output of the generating coil 1 through a circuit including the coil 1, the first input terminal 426*a*, the first output terminal 426*c*, the lamp 427, the ground, the ground terminal 426*e* and a diode 11*a*. In this case, when the voltage of the lamp 427 reaches a preset value, the voltage at the voltage dividing point a of the voltage divider circuit including the diode 409*a* and the resistors 409 and 410 exceeds a preset value and the thyristor 411 is turned on. As a result, the battery 20 is charged by a negative-going excess output of the coil 1 through a circuit including the coil 1, the first input terminal 426*a*, the thyristor 411, the second output terminal 426*d*, the battery 20, the ground, the ground terminal 426*e*, the diode 11*a* and the second input terminal 426*b*.

Figure 16:
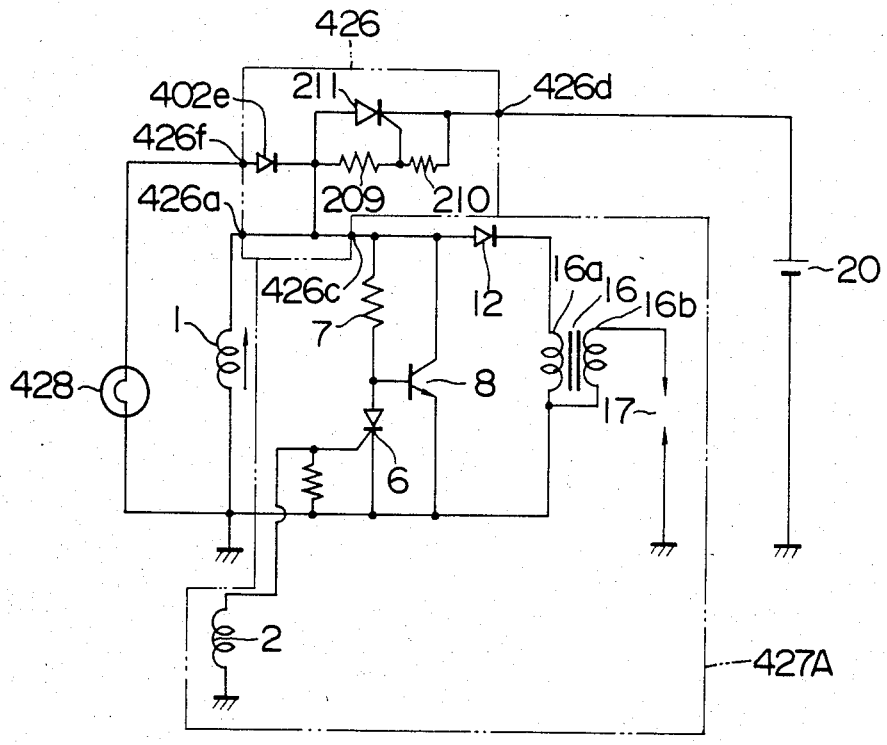

FIG. 16 shows a second embodiment of the fourth-type apparatus according to the invention which differs from the first embodiment of FIG. 15 in that the first load includes an ignition system 427A so that the battery 20 is charged only by an excess half cycle output of the ignition system 427A and that the half cycle output of the generating coil 1 not used for ignition purposes is supplied to a lamp 428 through a third output terminal 426*f* of the rectifier unit 426 and a diode 402*e*.

As in the case of the previously described embodiments, when an output is generated from the timing sensor coil 2 with a sufficient short-circuit current flowing in the transistor 8, the thyristor 6 is turned on and the base current of the transistor 8 is short-circuited. Thus, a high induced voltage is produced in the coil 1 and this induced voltage is applied to the primary winding 16*a* through the diode 12, thereby producing an ignition spark at the spark plug 17. Then, when the induced voltage produced in the coil 1 in response to every turning off of the transistor 8 exceeds a preset value, the thyristor 211 is turned on and the battery 20 is charged by the induced voltage of the coil 1.

Figure 17:
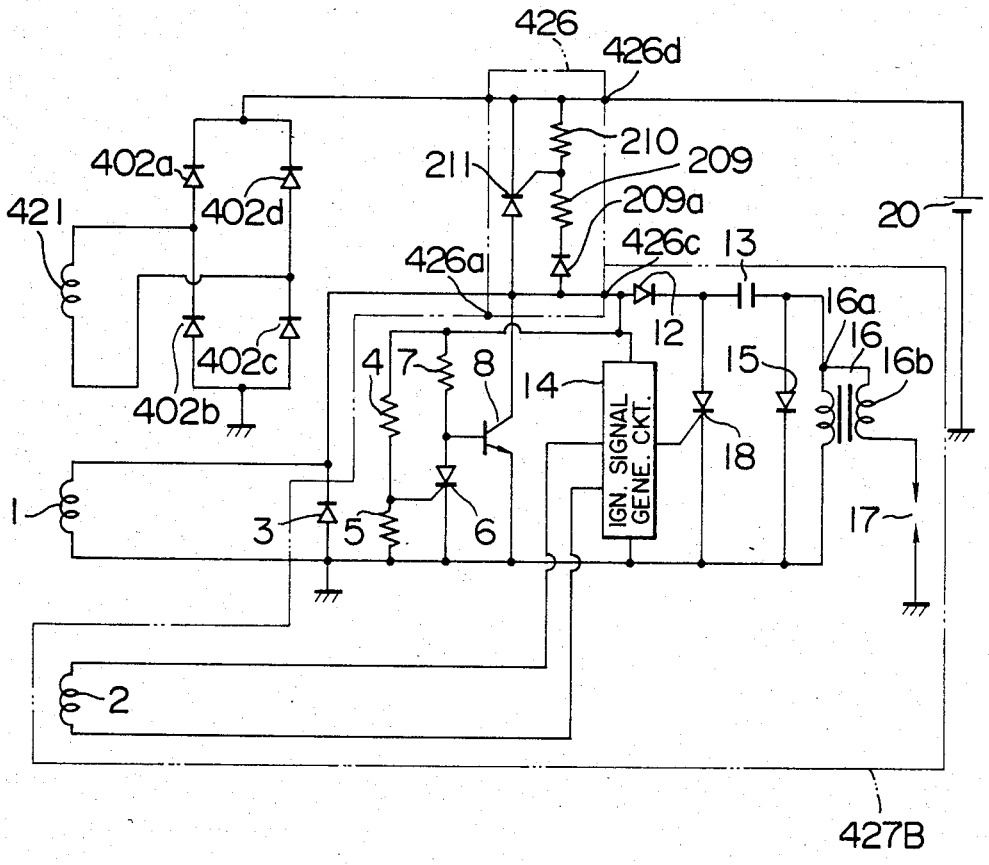

FIG. 17 shows a third embodiment of the fourth-type apparatus according to the invention in which the battery 20 is also charged by the output generated from another generating coil 421 of the magneto generator through a full-wave rectifying bridge including diodes 402*a* to 402*d*. An ignition system 427B including the ignition capacitor 13 and the ignition signal generating circuit 14 forms a first load. Also, when the induced voltage produced in the coil 1 in response to every turning off of the transistor 8 exceeds the preset value, then the thyristor 211 is turned on and the battery 20 is charged by the induced voltage of the coil 1.

In the above-described embodiments, it is of course possible to replace the first loads including the lamp 427 and the ignition systems 427A and 427B with one another. Further, in the above-described first embodiment of the fourth-type apparatus, the thyristor 411 may be designed to detect the current flowing to the lamp 427 so that it is turned on when the current exceeds a predetermined value.

Further, in the same first embodiment the junction point between the cathode of the thyristor 423 and the resistor 425 may be connected to the first input terminal 426*a* in place of the ground terminal 426*e*.

In accordance with these embodiments of the fourth-type apparatus, by virtue of the fact that whenever the voltage or current at the first output terminal for supplying the magneto generating coil output to the first load exceeds the predetermined value the thyristor is turned on and the output is supplied from the second output terminal to the second load, an excess output of the generating coil with respect to the first load can be supplied to the second load thus ensuring effective utilization of the generated output of the generating coil.

Further, due to the fact that the thyristor and the first to third diodes form a full-wave rectifying bridge to supply its output to the second load and that whenever a preset value is exceeded by that half cycle output of the generating coil output which is supplied to the second load alone that half cycle output is short-circuited by the regulator, not only the output from the generating coil can be supplied to the second load more effectively but also the output from the same generating coil can be supplied to the loads substantially independently of each other thereby simplifying the matching between the loads.

Figure 18:
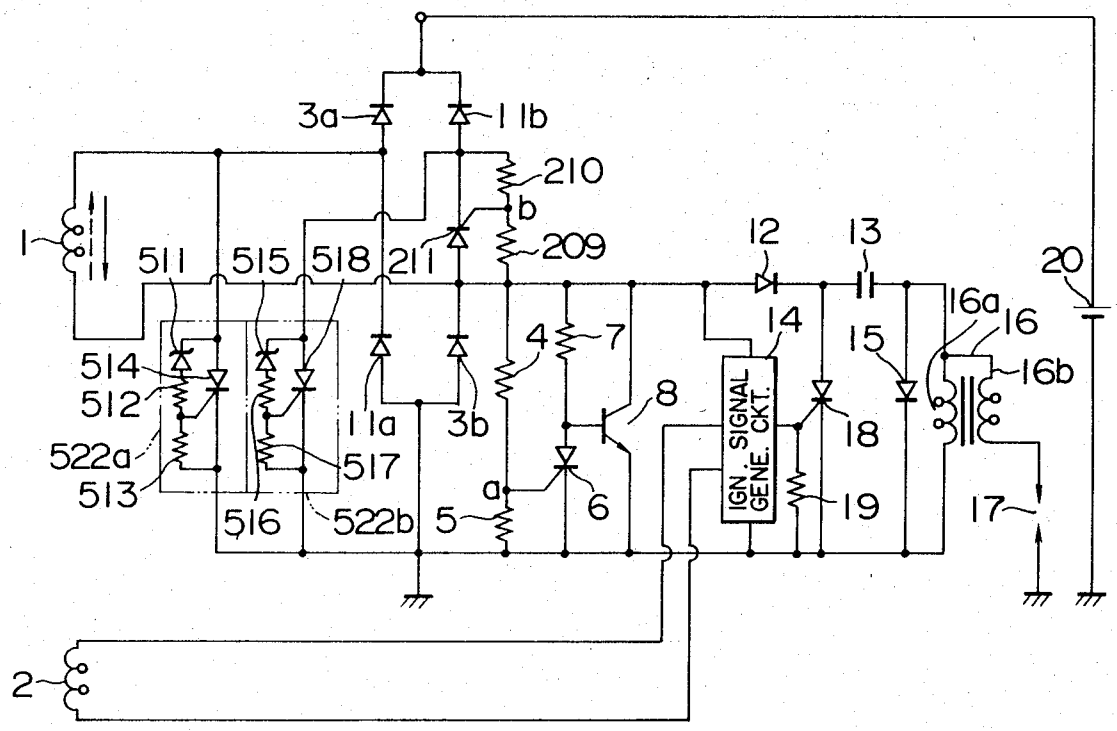
FIG. 18 is a circuit diagram showing a first embodiment of an apparatus of a fifth-type according to the invention.

Referring now to FIG. 18, there is illustrated a first embodiment of a fifth-type apparatus according to the invention in which the output of a high voltage responsive circuit responsive to an ignition capacitor charging half cycle high voltage is supplied to a load through a regulator and diodes. The positive-going half cycle output of the generating coil 1, shown by the solid line arrow, is supplied to the battery 20 through the reverse current blocking diodes 11*b* and 11*a*. Numeral 522*a* designates a known type of regulator for short-circuiting the negative-going output of the generating coil 1, shown by the broken line, when it exceeds a preset battery voltage, and the regulator includes a Zener diode 511 and voltage dividing resistors 512 and 513 forming a voltage detecting circuit and a thyristor 514 forming a shorting circuit. Numeral 522*b* designates a known type of regulator whereby when the cathode voltage of the thyristor 211 becomes higher than the preset battery voltage, the positive-going output of the generating coil 1, shown by the solid line arrow, is short-circuited through the thyristor 211 and the diode 11*a*, and the regulator includes a Zener diode 515 and voltage dividing resistors 516 and 517 forming a voltage detecting circuit and a thyristor 518 forming a shorting circuit.

Then, if a magneto generator of the type shown in FIG. 2 is used with this embodiment, six cycles of no-load ac voltage are generated in the generating coil 1 for every rotation of the magneto generator rotor as shown in (a) of FIG. 6. Thus, the circuitry of this embodiment operates with the similar operating, voltage and current characteristics (the short-circuit current of the transistor 8, the induced voltage of the coil 1, the voltage of the capacitor 13, the output voltage of the timing sensor coil 2 and the positive and negative charging currents of the battery 20) as the embodiment described with reference to FIGS. 5 and 6. Thus, characteristic relations as shown in FIG. 7 also hold in this embodiment.

In addition to the operation of the previously described embodiment, when the negative-going output of the generating coil 1 exceeds a preset battery voltage (e.g., about 14 V if the rated voltage of the battery 20 is 12 V), the regulator 522*a* comes into operation so that the negative-going half cycle output of the generating coil 1 is short-circuited and the battery 20 is prevented from being charged to an excessive extent.

Then, when the cathode voltage of the thyristor 211 exceeds the preset battery voltage (e.g., about 14 V), the regulator 522*b* comes into operation and the positive half cycle output of the generating coil 1 is short-circuited through the thyristor 211 and the diode 11*a* thereby preventing any overcharging of the battery 20. In this case, even if the terminal of the battery 20 is disconnected, the positive half cycle output of the generating coil 1 is short-circuited through the thyristor 211 and the diode 11*a* due to the operation of the regulator 522*b*. As a result, if, due to the disconnection of the battery terminal or the like, the battery 20 fails to absorb an excessively high voltage induced in the generating coil 1 after the turning off of the transistor 8, this excessively high voltage as well as the following successively generated positive half cycle output can be absorbed by the regulator 522*b*. In this case, the diode 11*b* prevents the battery 20 from being short-circuited through the regulator 522*b* when the latter is in operation.

Figure 19:
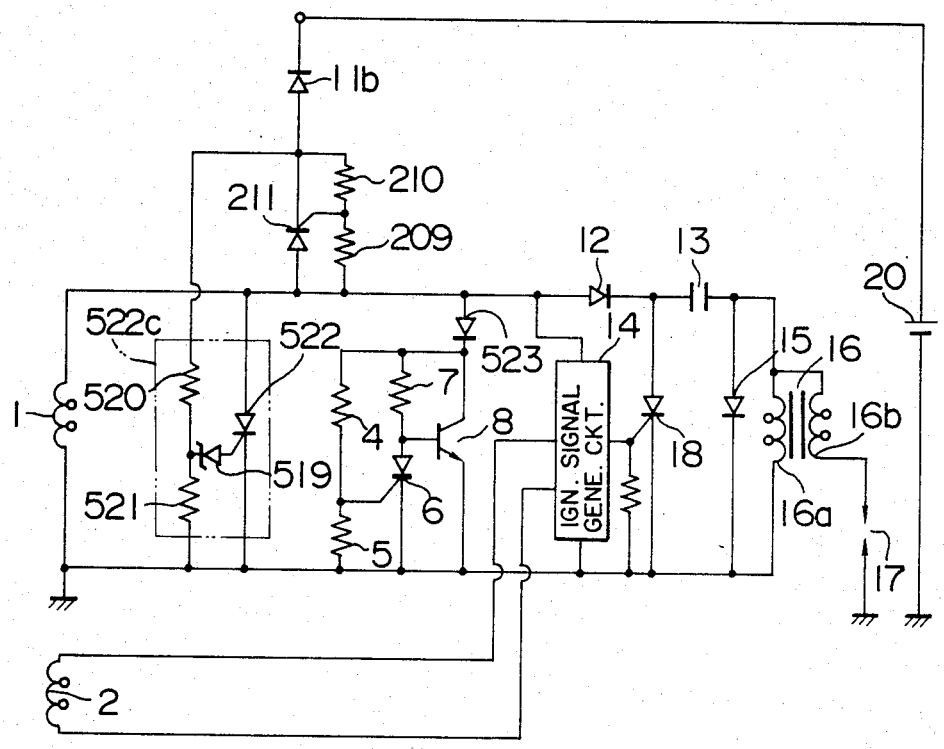
FIGS. 19 and 20 are circuit diagrams showing second and third embodiments of the fifth-type apparatus according to the invention.

FIG. 19 shows a second embodiment of the fifth-type apparatus according to the invention which differs from the first embodiment of FIG. 18 in that the diodes 3*a*, 3*b* and 11*a* and the regulator 522*a* are eliminated to charge the battery 20 only with a high voltage induced in the generating coil 1 upon turning off the transistor 8, that the anode of a thyristor 522 is connected to the junction point of the generating coil 1 and the anode of the thyristor 211 in place of the thyristor 518 of the regulator 522*b* and that a diode 523 is added. In protects the transistor 8 from a reverse voltage of the coil 1. In this second embodiment, the diode 11*b* functions in such a manner that when the battery voltage is higher than the preset battery voltage, a regulator 522*c* operates continuously and prevents the capacitor 13 from being not charged even if the thyristor 211 is turned off by the high battery voltage.

Figure 20:
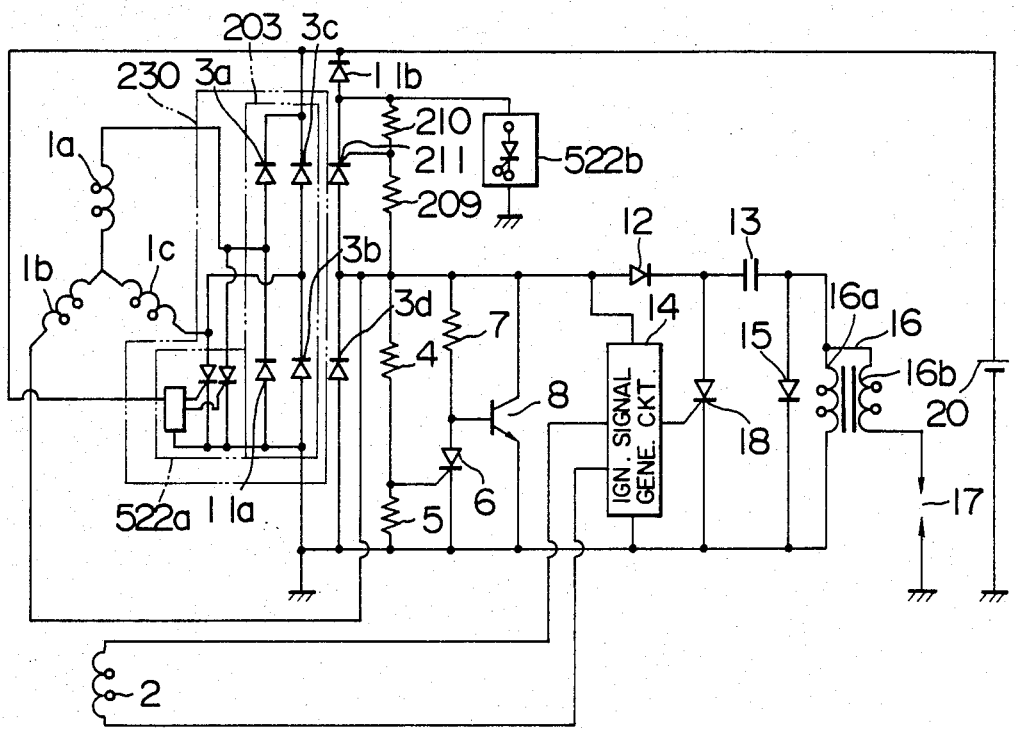

FIG. 20 shows a third embodiment of the fifth-type apparatus according to the invention which is a modification of the construction of FIG. 18 to suit the arrangement of three-phase generating coils and which is generally the same with the embodiment of FIG. 9 except that the regulator 522*b* and the diode 11*b* are added in correspondence to the construction of FIG. 18.

Figure 21:
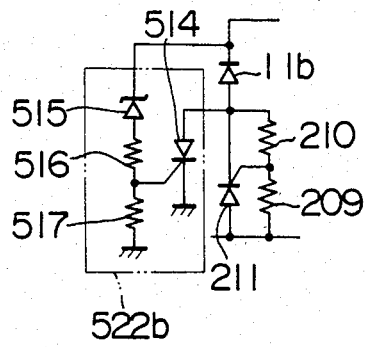
FIG. 21 is a circuit diagram showing another example of the connection of the regulators used in the respective embodiments.

Not only the connection of the regulator 522*b* can be changed as shown in FIGS. 18 and 19, but also the similar operation as FIG. 18 can also be performed by connecting the anode of the thyristor 514 of the regurator 522*b* between the thyristor 211 and the diode 11*b* and connecting the voltage detecting circuit of the regulator 522*b* to the catahode of the diode 11*b* as shown in FIG. 21.

Figure 22:
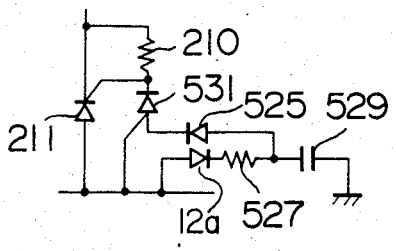
FIG. 22 is a circuit diagram showing another example of the high voltage responsive circuit used in the above-described embodiments of the invention.

Also, the high voltage responsive circuit may be designed so that, as shown in FIG. 22, the stored charge on a capacitor 529 charged by a pulse like induced voltage of the coil 1 through a diode 12*a* and a resistor 527 is supplied to the gate of the thyristor 211 through a diode 525 and a programmable unijunction transistor 531 such that the thyristor 211 is turned on just after the time at which the peak point is exceeded by the induced voltage of the coil 1 just following the turning off of the transistor 8. In accordance with this embodiment, although a pulse like high voltage induced in the coil 1 cannot be absorbed by the battery 20 and the regulator 522*b*, this high voltage is generated in pulse like form only for a short period of time and the following positive half cycle output induced in the coil 1 for a relatively long period can be absorbed by the battery 20 and the regulator 522*b*, thereby satisfactorily reducing the generation of heat in the resistors 4, 5 and 7 and the thyristor 6 of the interruption control circuit.

While, in the above-described embodiments, the electronic ignition signal generating circuit 14 is used which receives the output signal of the timing sensor coil 2 and electronically computes the desired ignition timing, it is possible to use an ignition signal generating cirucit of a type which generates a negative-going output of the generating coil 1 as an ignition signal or an ignition signal generating circuit of a type which directly applies the output signal of the timing sensor coil 2 as a control signal to the thyristor 18.

As described hereinabove, in accordance with the embodiments of the fifth-type apparatus according to the invention, by virtue of the fact that the high voltage induced in the generating coil upon turning off the shorting semiconductor switching element is detected and the high voltage responsive circuit continues to supply the one half cycle output of the generating coil to the battery through the reverse current blocking diodes each time the high voltage exceeds a preset value or just after the rise of the high voltage beyond the peak point and that the one half cycle output of the generating circuit is short-circuited by the regulator when the output voltage of the high voltage responsive circuit exceeds a preset charged voltage of the battery, not only the induced voltage of the generating coil is maintained at the preset value and the following successively generated undesired voltages are supplied to the battery thereby charging the battery effectively, but also the charged battery voltage is controlled satisfactorily by the regulator thereby preventing any overcharging event of the battery and the ignition function is not degraded in case of the disconnection of the battery terminal thereby positively reducing the generation of heat in the interruption control circuit.

Figure 23:
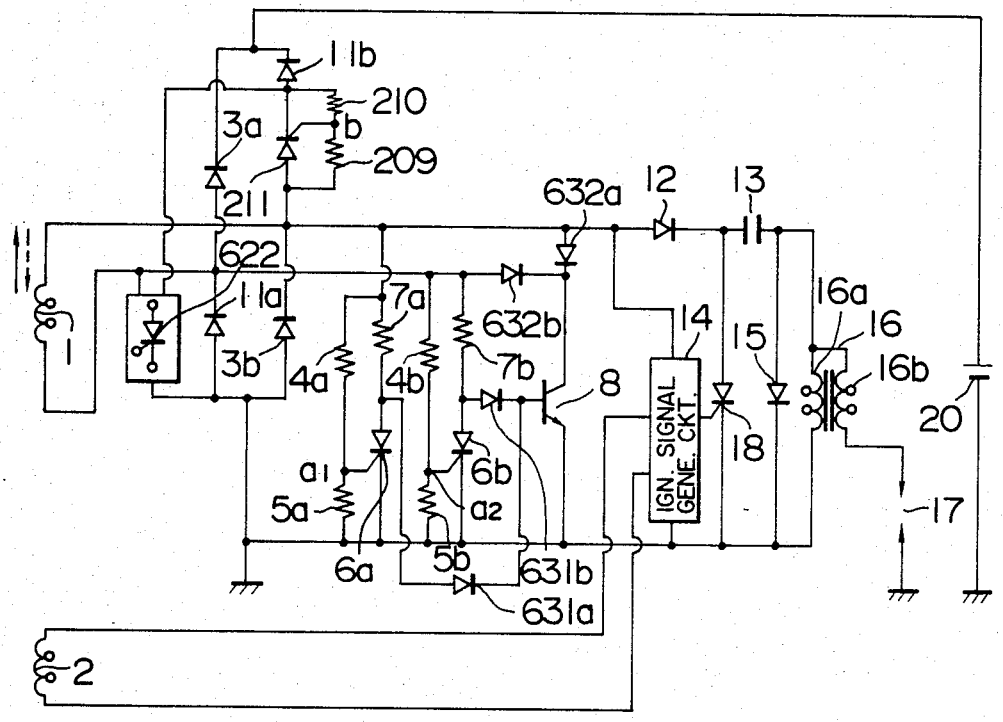
FIG. 23 is a circuit diagram showing a first embodiment of an apparatus of a sixth-type according to the invention.

FIG. 23 shows a first embodiment of a sixth-type apparatus according to the invention in which the positive-going and negative-going outputs of the generating coil are interrupted rapidly and the resulting high induced voltages are used to charge the ignition capacitor and the battery, respectively. Numerals 4*a*, 4*b*, 5*a* and 5*b* designate two sets of series connected voltage driving resistors connected between the terminals of the generating coil 1 through the diodes 3*a* and 11*a*, and their voltage dividing points $a_1$ and $a_2$ are connected to the gate of thyristors 6*a* and 6*b*, respectively. The thyristors 6*a* and 6*b* are connected between the base and emitter of the transistor 8 through diodes 631*a* and 631*b*, respectively. Numerals 7*a* and 7*b* designate base resistors of the transistor 8 so that a first interruption control circuit is formed by the resistor 7*a*, the thyristor 6*a* and the resistors 4*a* and 5*a* and a second interruption control circuit is formed by the resistor 7*b*, the thyristor 6*b* and the resistors 4*b* and 5*b*. The transistor 8 is connected between the terminals of the generating coil 1 and the ground through diodes 632*a* and 632*b*, respectively, so that a first shorting circuit is formed by the diode 632*a* and the transistor 8 and a second shorting circuit is formed by the diode 632*b* and the transistor 8. Numeral 622 designates a known type of regulator for short-circuiting the half cycle outputs of the generating coil 1 when the negative-going output of the generating coil 1, shown by the broken line, and the cathode voltage of the thyristor 211 exceeds a preset battery voltage.

Assuming that this embodiment is used with a magneto generator of the type shown in FIG. 2, as a half cycle output of the solid line arrow direction (positive direction) of FIG. 23 starts generating in the generating coil 1, a base current flows to the transistor 8 through a circuit including the coil 1, the resistor 7*a*, the diode 631*a*, the base and emitter of the transistor 8, the ground and the diode 11*a*, so that the collector-emitter section of the transistor 8 is turned on and the positive-going half cycle output of the coil 1 is short-circuited. The resulting increase in the short-circuit current in the transistor 8 increases the voltage drop across the diode 632*a* and the collector and emitter of the transistor 8 and the voltage at the junction point $a_1$ of the voltage divider including the resistors 4*a* and 5*a* is increased. When this voltage attains a preset value (e.g., a voltage value corresponding to a short-circuit current of 0.5 to 4 A), the thyristor 6*a* is turned on and the base-emitter section of the transistor 8 is short-circuited. Thus, the collector-emitter section of the transistor 8 is turned off and the short-circuit current is interrupted rapidly. At this time, a high positive-going induced voltage is generated in the coil 1 and this high voltage charges the capacitor 13 sufficiently. Also, when the induced voltage exceeds the preset value as mentioned previously, the battery 20 is charged through the thyristor 211 and the diodes 11*b* and 11*a* and the positive-going half cycle output of the coil 1 is maintained at the battery voltage thereby preventing the application of any excessive voltage to the respective elements.

On the other hand, when a half cycle output of the broken line arrow direction (negative direction) begins to be generated in the generating coil 1, a base current flows to the transistor 8 through a circuit including the coil 1, the resistor 7*b*, the diode 631*b*, the base and emitter of the transistor 8, the ground and the diode 3*b* so that the collector-emitter section of the transistor 8 is turned on and the negative-going half cycle output of the coil 1 is short-circuited. Thus, the short-circuit current in the transistor 8 is increased so that the voltage drop across the diode 632*b* and the collector-emitter section of the transistor 8 is increased and the voltage at the junction point $a_2$ of the voltage divider including the resistors 4*b* and 5*b* is increased. When this voltage reaches a preset value (e.g., a voltage value corresponding to a short-circuit current of 0.5 to 4 A), the thyristor 6*b* is turned on and the base-emitter section of the transistor 8 is short-circuited. Thus, the collector-emitter section of the transistor 8 is turned off and the short-circuit current is interrupted rapidly. Then, a high negative-going induced voltage is generated in the coil 1 and this high voltage charges the battery 20 through the diodes 3*a* and 3*b*. By thus charging the battery 20, the negative-going half cycle output of the coil 1 is maintained at the battery voltage and the application of any excessive voltage to the respective elements is prevented.

Also, when the negative-going output of the generating coil 1 exceeds a preset value (e.g., about 14 V if the rated voltage of the battery 20 is 12 V), the regulator 622 comes into operation and the negative-going half cycle output of the generating coil 1 is short-circuited thereby preventing any overcharging of the battery 20.

Then, as the cathode voltage of the thyristor 211 exceeds the preset battery voltage (e.g., about 14 V) so that the regulator 622 comes into operation, the positive-going half cycle output of the generating coil 1 is short-circuited through the thyristor 211 and the diode 11*a* and the battery 20 is prevented from being charged excessively. In this connection, the diode 11*b* functions to prevent the battery 20 from being short-circuited by the regulator 622 when the later is in operation.

Figure 24:
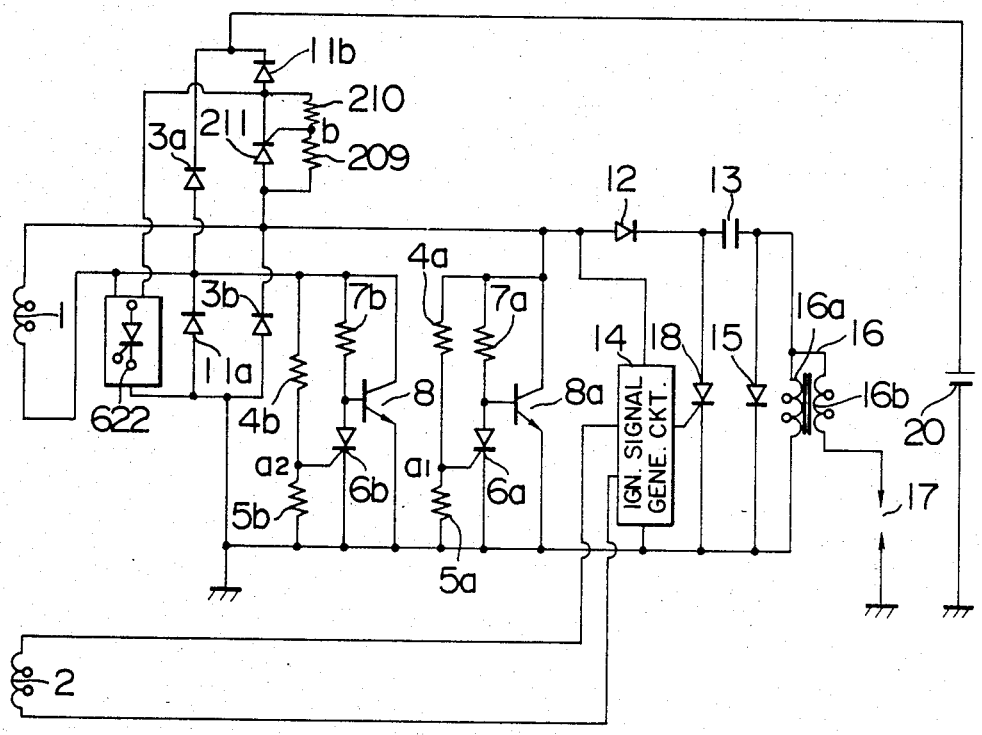
FIG. 24 is a circuit diagram showing a second embodiment of the sixth-type apparatus according to the invention.

FIG. 24 shows a second embodiment of the sixth-type apparatus according to the invention which differs from the first embodiment of FIG. 23 in that the generated output shorting transistor 8 is replaced by a forward shorting transistor 8*a* and a reverse shorting transistor 8*b* which are arranged separately to form first and second shorting circuits and that the diodes 631*a*, 631*b*, 632*a* and 632*b* are eliminated.

While, in the above-described embodiments, the battery 20 is used as the other load, the other load may be comprised of the head lamps or the like. Further, while, in these embodiments, the thyristor 211 is turned on when the positive induced voltage of the coil 1 attains the preset value, it is possible to arrange so that the thyristor 211 is turned on through a peak point detecting circuit just after each time the positive induced voltage of the coil 1 exceeds the peak point.

In accordance with the above-described embodiments of the sixth-type apparatus, by virtue of the fact that the high voltage induced in the generating coil upon opening the first shorting circuit is detected and the one half cycle output of the generating coil is supplied successively to the other load, e.g., the battery by means of the high voltage responsive circuit each time the detected high voltage exceeds the preset value or just after the peak point is exceeded by the high voltage and that the second interruption control circuit is provided such that the second shorting circuit is opened when the short-circuit current is flowing sufficiently in the second shorting circuit adapted to substantially short-circuit the other half cycle output of the generating coil thereby supplying the high voltage of the opposite polarity induced in the generating coil upon opening the second shorting circuit to the load such as the battery, there is a great advantage that the generated output of the generating coil forming an ignition capacitor charging source can be utilized effectively to supply a sufficient power to the other load, e.g., the battery with the result that not only the construction of the generator is simplified but also the generating efficiency of the generator is improved.

I claim:

1. An apparatus for controlling the supply of an output from a magneto generator of an ignition system comprising:

a generating coil of said magneto generator;

a shorting semiconductor switching element for substantially short-circuiting an output from said generating coil;

an interruption control circuit for turning off said shorting semiconductor switching element when a short-circuit current flowing therethrough reaches a predetermined value;

a capacitor disposed to be charged by a high voltage induced in said generating coil when said shorting semiconductor switching element is turned off;

an ignition coil having a primary winding and a secondary winding;

an ignition signal generating circuit voltage regulator circuit connected in series with said shorting semiconductor switching element to receive an output supplied from said generating coil in response to the turning on of said shorting semiconductor switching element and generate a constant voltage output;

an ignition signal generating circuit for receiving said constant voltage output from said voltage regulator circuit as a power supply and generating an ignition signal;

an ignition semiconductor switching element responsive to said ignition signal from said ignition signal generating circuit to turn on and thereby supply a stored charge on said capacitor to the primary winding of said ignition coil; and a spark plug connected to the secondary winding of said ignition coil.

2. An apparatus for controlling the supply of an output from a magneto generator of an ignition system comprising:

a generating coil of said magneto generator for generating a plurality of cycles of AC output for each revolution of said magneto generator;

a shorting semiconductor switching element for substantially short-circuiting a half cycle output of one polarity from said generating coil;

an interruption control circuit for turning off said shorting semiconductor switching element when a set value of short-circuit current flows therethrough;

a capacitor disposed to be charged by a high voltage induced in said generating coil when said shorting semiconductor switching element is turned off;

an ignition coil having a primary winding and a secondary winding;

an opposite polarity half cycle conducting diode for conducting a current caused by a half cycle output of the opposite polarity from said generating coil;

an ignition signal generating circuit for generating an ignition signal at an ignition timing;

an ignition semiconductor switching element responsive to said ignition signal from said ignition signal generating circuit to turn on and thereby supply a stored charge on said capacitor to the primary winding of said ignition coil; and a spark plug connected to the secondary winding of said ignition coil.

3. A contactless ignition system for an internal combustion engine comprising:

a generating coil of a magneto generator for generating a plurality of cycles of AC output for each revolution of said magneto generator;

a shorting semiconductor switching element for substantially short-circuiting a half cycle output of one polarity from said generating coil;

an interruption control circuit for turning off said shorting semiconductor switching element when a set value of short-circuiting current flows therethrough;

a capacitor disposed to be charged by a high voltage induced in said generating coil upon the turning off of said shorting semiconductor switching element;

an ignition coil having a primary winding and a secondary winding;

a high voltage responsive circuit for detecting the voltage induced in said generating coil upon the turning off of said shorting semiconductor switching element, whereby each time said high voltage exceeds a predetermined value, a half cycle output of one polarity from said generating coil is continuously supplied to bypass said capacitor;

a discharge blocking diode connected in series in a charging circuit of said capacitor;

an ignition signal generating circuit for generating an ignition signal at an ignition timing;

an ignition semiconductor switching element responsive to the ignition signal from said ignition signal generating circuit to turn on and thereby supply a stored charge on said capacitor to said primary winding of said ignition coil; and a spark plug connected to said secondary winding of said ignition coil.

4. A contactless ignition system for an internal combustion engine comprising:

a generating coil of a magneto generator;

a shorting semiconductor switching element for substantially short-circuiting a half cycle output of one polarity from said generating coil;

an interruption control circuit for turning off said shorting semiconductor switching element when a set value of short-circuit current flows therethrough;

a capacitor disposed to be charged by a high voltage induced in said generating coil upon the turning off of said shorting semiconductor switching element;

an ignition coil having a primary winding and a secondary winding;

a high voltage responsive circuit for detecting the high voltage induced in said generating coil upon the turning off of said shorting semiconductor switching element, whereby each time said high voltage exceeds a predetermined value, a half cycle output of one polarity from said generating coil is continuously supplied to another load different from said capacitor;

a discharge blocking diode connected in series in a charging circuit of said capacitor;

an ignition signal generating circuit for generating an ignition signal at an ignition timing;

an ignition semiconductor switching element responsive to the ignition signal from said ignition signal generating circuit to turn on and thereby supply a stored charge on said capacitor to said primary winding of said ignition coil; and a spark plug connected to said secondary winding of said ignition coil.

5. A contactless ignition system according to claim 4, further comprising a shorting diode for short-circuiting a half cycle output of the opposite polarity of said generating coil.

6. A contactless ignition system according to claim 4, further comprising an opposite polarity half cycle conducting diode for supplying to said another load a half cycle output of the opposite polarity of said generating coil.

7. A contactless ignition system according to claim 4, wherein said another load is a battery.

8. A contactless ignition system according to claim 4, wherein said interruption control circuit includes a current detecting circuit for detecting a short-circuiting current flowing through said shorting semiconductor switching element, and an interruption semiconductor switching element for interrupting said shorting semiconductor switching element when said current detecting circuit detects that the short-circuiting current flowing through said shorting semiconductor switching element reaches a set value.

9. A contactless ignition system according to claim 8, wherein said generating coil generates a plurality of cycles of AC output for each revolution of said magneto generator.

10. An apparatus according to claim 1, wherein said voltage regulator circuit comprises a series circuit of a diode and a dc power supply capacitor, and a regulator connected in parallel with said series circuit so as to be turned on when a terminal voltage of said dc power supply capacitor exceeds a predetermined value.

11. An apparatus according to claim 2, further comprising a high voltage responsive circuit for detecting a high voltage induced in said generating coil upon the turning off of said shorting semiconductor switching element whereby when said high voltage exceeds a predetermined value a half cycle output of one polarity from said generating coil is continuously supplied to bypass said capacitor, and a discharge blocking diode connected in series in a charging circuit of said capacitor.

12. An apparatus according to claim 2, wherein said opposite polarity half cycle conducting diode supplies a half cycle output of the opposite polarity from said generating coil to another load.

13. An apparatus according to claim 7, further comprising a reverse current blocking diode connected between said high voltage responsive circuit and said battery to supply to said battery the one polarity half cycle output of said generating coil exceeding said predetermined value, and another regulator for short-circuiting said one polarity half cycle output of said generating coil when the output voltage of said high voltage responsive circuit exceeds a predetermined charged voltage of said battery.

14. An apparatus according to claim 4, further comprising a second shorting circuit for substantially short-circuiting the opposite polarity half cycle output of said generating coil, a second interruption control circuit for interrupting said second shorting circuit when there is a sufficient short-circuit current flow therethrough, and other opposite polarity half cycle conducting diodes for supplying a high voltage induced upon the interruption of said second shorting circuit to said another load.

* * * * *